US009665027B2

(12) United States Patent
Matsuoka

(10) Patent No.: US 9,665,027 B2
(45) Date of Patent: May 30, 2017

(54) IMAGE FORMING SYSTEM, CONTROLLER AND RECORDING MEDIUM, CONFIGURED TO CORRECT GRADATION OF WHITE COLORING MATERIAL

(71) Applicant: Taira Matsuoka, Kanagawa (JP)

(72) Inventor: Taira Matsuoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 3 days.

(21) Appl. No.: 14/789,213

(22) Filed: Jul. 1, 2015

(65) Prior Publication Data

US 2016/0041488 A1 Feb. 11, 2016

(30) Foreign Application Priority Data

Aug. 5, 2014 (JP) ..... 2014-159544

(51) Int. Cl.
*G03G 15/00* (2006.01)
*G03G 15/01* (2006.01)

(52) U.S. Cl.
CPC ..... *G03G 15/01* (2013.01); *G03G 15/5062* (2013.01); *G03G 2215/00569* (2013.01)

(58) Field of Classification Search
CPC ..... G03G 15/01; G03G 15/5025; G03G 15/5058; G03G 15/5054; G03G 15/5062; G03G 15/50; G03G 15/0131; G03G 15/5041; G03G 2215/00067; G03G 2215/00063
USPC ..... 399/15
See application file for complete search history.

(56) References Cited

U.S. PATENT DOCUMENTS 3,510,299 A * 5/1970 Herrick, Jr. ..... G03G 5/0507 252/511
6,418,281 B1 * 7/2002 Ohki ..... G03G 15/5062 358/300
2010/0118347 A1 5/2010 Ishii
2014/0369701 A1 * 12/2014 Kuo ..... G03G 15/50 399/15

(Continued)

FOREIGN PATENT DOCUMENTS

JP 2002-268318 9/2002
JP 2008-298854 12/2008
JP 2010-118927 5/2010

*Primary Examiner* — Walter L Lindsay, Jr.
*Assistant Examiner* — Jessica L Eley
(74) *Attorney, Agent, or Firm* — Cooper & Dunham LLP

(57) ABSTRACT

An image forming system includes an image former forming an image with a white coloring material and a colored coloring material; an output controller controlling the image former to output a first correction sheet formed with the colored coloring material, and a second correction sheet including a first layer formed with the colored coloring material and a second layer formed with the white coloring material overlying the first layer; a density measurer measuring color densities of the first and the second correction sheets; a first corrector correcting a gradation of the colored coloring material, based on the measured color density of the first correction sheet; and a second corrector correcting a gradation of the white coloring material, based on the measured color density of the second correction sheet including the first layer formed with a gradation value in accordance with the gradation correction result of the colored coloring material.

9 Claims, 18 Drawing Sheets

(56) References Cited

U.S. PATENT DOCUMENTS

2015/0093553 A1* 4/2015 Tyagi ..... B42D 15/0093
428/207
2015/0346622 A1* 12/2015 Itoh ..... G03G 15/01
399/39

* cited by examiner

| PATCH | GRADATION VALUE (W) | GRADATION VALUE (K) | GRADATION VALUE (C) | GRADATION VALUE (M) | GRADATION VALUE (Y) |
|---|---|---|---|---|---|
| K00 | 0 | 0 | 0 | 0 | 0 |
| K01 | 0 | 16 | 0 | 0 | 0 |
| K02 | 0 | 32 | 0 | 0 | 0 |
| K03 | 0 | 48 | 0 | 0 | 0 |
| K04 | 0 | 64 | 0 | 0 | 0 |
| K05 | 0 | 80 | 0 | 0 | 0 |
| K06 | 0 | 96 | 0 | 0 | 0 |
| K07 | 0 | 112 | 0 | 0 | 0 |
| K08 | 0 | 128 | 0 | 0 | 0 |
| K09 | 0 | 143 | 0 | 0 | 0 |
| K10 | 0 | 159 | 0 | 0 | 0 |
| K11 | 0 | 175 | 0 | 0 | 0 |
| K12 | 0 | 191 | 0 | 0 | 0 |
| K13 | 0 | 207 | 0 | 0 | 0 |
| K14 | 0 | 223 | 0 | 0 | 0 |
| K15 | 0 | 239 | 0 | 0 | 0 |
| K16 | 0 | 255 | 0 | 0 | 0 |

| AREAL RATIO (BLACK TONER) | EXPECTED VALUE | MEASURED VALUE |
|---|---|---|
| 0 | 0.15 | 0.150 |
| 6 | 0.31 | 0.318 |
| 13 | 0.47 | 0.486 |
| 19 | 0.63 | 0.654 |
| 25 | 0.77 | 0.801 |
| 31 | 0.90 | 0.938 |
| 38 | 1.02 | 1.064 |
| 44 | 1.14 | 1.190 |
| 50 | 1.22 | 1.274 |
| 56 | 1.29 | 1.347 |
| 62 | 1.34 | 1.400 |
| 69 | 1.40 | 1.463 |
| 75 | 1.45 | 1.515 |
| 81 | 1.50 | 1.568 |
| 87 | 1.54 | 1.610 |
| 94 | 1.57 | 1.641 |
| 100 | 1.60 | 1.673 |

| PATCH | GRADATION VALUE (W) | GRADATION VALUE (K) | GRADATION VALUE (C) | GRADATION VALUE (M) | GRADATION VALUE (Y) |
|---|---|---|---|---|---|
| K00 | 0 | 184 | 0 | 0 | 0 |
| K01 | 16 | 184 | 0 | 0 | 0 |
| K02 | 32 | 184 | 0 | 0 | 0 |
| K03 | 48 | 184 | 0 | 0 | 0 |
| K04 | 64 | 184 | 0 | 0 | 0 |
| K05 | 80 | 184 | 0 | 0 | 0 |
| K06 | 96 | 184 | 0 | 0 | 0 |
| K07 | 112 | 184 | 0 | 0 | 0 |
| K08 | 128 | 184 | 0 | 0 | 0 |
| K09 | 143 | 184 | 0 | 0 | 0 |
| K10 | 159 | 184 | 0 | 0 | 0 |
| K11 | 175 | 184 | 0 | 0 | 0 |
| K12 | 191 | 184 | 0 | 0 | 0 |
| K13 | 207 | 184 | 0 | 0 | 0 |
| K14 | 223 | 184 | 0 | 0 | 0 |
| K15 | 239 | 184 | 0 | 0 | 0 |
| K16 | 255 | 184 | 0 | 0 | 0 |

| AREAL RATIO (WHITE TONER) | EXPECTED VALUE | MEASURED VALUE |
|---|---|---|
| 0 | 1.49 | 1.490 |
| 6 | 1.46 | 1.465 |
| 13 | 1.43 | 1.439 |
| 19 | 1.40 | 1.405 |
| 25 | 1.35 | 1.363 |
| 31 | 1.30 | 1.320 |
| 38 | 1.24 | 1.269 |
| 44 | 1.20 | 1.227 |
| 50 | 1.13 | 1.167 |
| 56 | 1.06 | 1.099 |
| 62 | 0.94 | 0.997 |
| 69 | 0.83 | 0.895 |
| 75 | 0.71 | 0.784 |
| 81 | 0.57 | 0.665 |
| 87 | 0.42 | 0.529 |
| 94 | 0.27 | 0.393 |
| 100 | 0.12 | 0.257 |

IMAGE FORMING SYSTEM, CONTROLLER AND RECORDING MEDIUM, CONFIGURED TO CORRECT GRADATION OF WHITE COLORING MATERIAL

CROSS-REFERENCE TO RELATED APPLICATIONS

This patent application is based on and claims priority pursuant to 35 U.S.C. §119 to Japanese Patent Application No. 2014-159544, filed on Aug. 5, 2014, in the Japan Patent Office, the entire disclosure of which is hereby incorporated by reference herein.

BACKGROUND

Technical Field

The present invention relates to an image forming system, a controller and a non-transitory recording medium. More particularly, the present invention relates to an image forming system capable of forming images with a white coloring material, a controller, and a non-transitory recording medium.

Description of the Related Art

Besides toners for 4 process colors (CMYK, i.e., cyan, magenta, yellow and black), an image forming apparatus capable of forming images with a white color including a white pigment and a binder resin as main components not including a colored coloring material is conventionally known.

The white toner attracts attention as a coloring material to bring various added value for a print use to a transparent recording medium, a piece of cloth, colored papers other than faithful color reproduction by the process color. For example, an imaging apparatus producing desired white is known by placing a white toner as the bottom layer on a recording medium to interrupt the color development of the recording medium. In addition, an imaging apparatus producing images unproducible with only a transparent recording medium and a toner of the process color is known by printing a white toner on the back side of the transparent recording medium. Furthermore, a technique to use a white toner solid image instead of a white standard board for correcting in an imaging apparatus detecting an optical density of a toner image formed on an intermediate transferer by an optical sensor is known.

SUMMARY

Accordingly, one object of the present invention is to provide an image forming system capable of correcting gradation of a white coloring material to obtain stable whiteness while saving consumption of the white coloring material.

Another object of the present invention is to provide a controller controlling the image forming system.

A further object of the present invention is to provide a program programming the controller, stored in a non-transitory recording medium.

These objects and other objects of the present invention, either individually or collectively, have been satisfied by the discovery of an image forming system, including an image former to form an image with a white coloring material and a colored coloring material; an output controller to control the image former to output a first correction sheet formed with the colored coloring material, and a second correction sheet including a first layer formed with the colored coloring material and a second layer formed with the white coloring material overlying the first layer; a density measurer to measure a color density of each of the first correction sheet and the second correction sheet; a first corrector to correct a gradation of the colored coloring material on the basis of the measured color density of the first correction sheet; and a second corrector to correct a gradation of the white coloring material on the basis of the measured color density of the second correction sheet including the first layer formed with a gradation value in accordance with the gradation correction result of the colored coloring material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
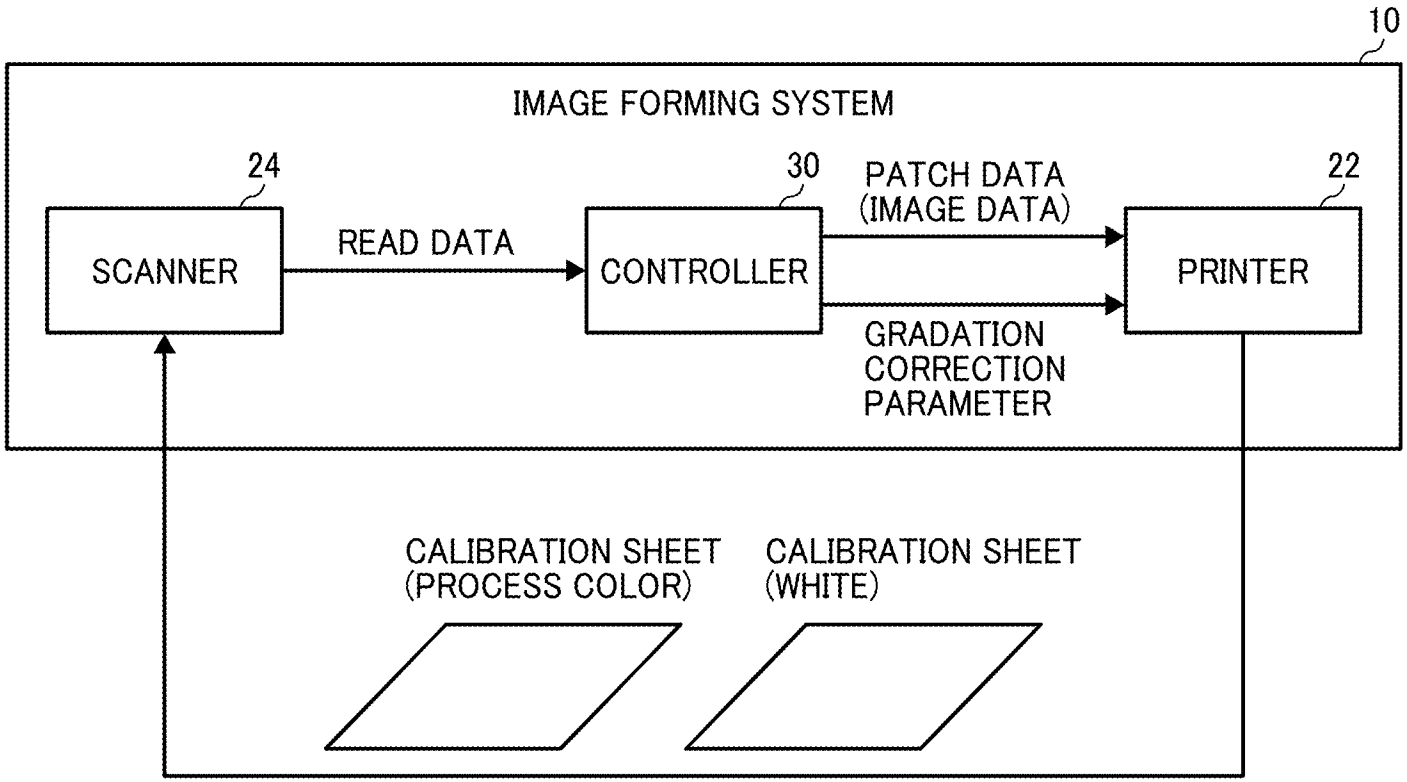
FIG. 1 is a schematic view illustrating a first embodiment of the image forming system of the present invention.

The recent image forming system capable of forming images with a white coloring material is unable to execute correcting of color materials such as white toners and keep stable whiteness level. In addition, there is a demand for saving consumption of color materials as much as possible when correction is made.

The present invention provides an image forming system correcting gradation of a white coloring material to obtain stable whiteness while saving consumption of the white coloring material.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

First Embodiment (Outline Configuration of Image Forming System)

FIG. 1 is a schematic view illustrating a first embodiment of the image forming system 10 of the present invention. The image forming system 10 includes a printer 22 which is an image former in this embodiment, a scanner 24 which is a density measurer therein, and a controller 30.

Having a one-drum color plotter, the printer 22 transfers a toner image formed on a photoreceptor drum onto a paper by electrophotographic process with a laser beam, fixes the toner image thereon with heat and pressure, and outputs the fixed image. In addition to developing units for four process color toners C (cyan), M (magenta), Y (yellow) and K (black), the printer 22 include a developing unite for W (white) toner. Namely, the printer 22 is capable of forming an image on a recording medium with colored coloring materials for C, M, Y and K, and is capable of forming an image with a white coloring material as well.

Further, the printer 22 includes a circulating conveyance path, refeeds a recording medium through the circulating conveyance path after a first round toner image is fixed, and transfers fixes a second round toner image on the recording medium. Further, the printer 22 includes a reversing conveyance path, and is capable of transferring and fixing a toner image on an opposite side of a recording medium after transferring and fixing a toner image on one side. Japanese published unexamined application No. JP-2002-268318-A discloses such a circulating conveyance path.

The scanner 24 includes a color line sensor consisting of a photoelectric conversion element such as a color CCD (Charge Coupled Device) or a color CMOS (Complementary Metal Oxide Semiconductor) and an A/D (Analogue to Digital) converter. The scanner 24 scans optically scans a recording medium placed on contact glass, subjects the reflected light to A/D conversion to be subject to image processing such as the gamma conversion, and reads the surface density of the recording medium. The scanner 24 produces image data of RGB of predetermined image resolution and gradation depth (e.g., each of RGB is 8 to 10 bits).

The controller 30 includes a processor and a memory such as CPU (Central Processing Unit), reads a program stored in a storage such as ROM (Read Only Memory) and HDD (Hard Disk Drive), develops the program on a memory and executes the program. Thus, the controller 30 controls the printer 22 and the scanner 24. In addition, the controller 30 executes various operation processes including calibration mentioned later.

The image forming system 10 is not particularly limited, but is a multi-function printer (MFP) including the printer 22, the scanner 24 and the controller in a body in this embodiment.

The printer 22 occasionally produces pixels having different densities on recording media even when producing them on the basis of the same image data because components and assembling structure vary as time passes.

In this embodiment, the image forming system 10 includes a calibration (correction) mode. A user operates an operation panel to switch the ordinary printing mode printing data made by word processors of the image forming system 10 to the calibration mode. When the mode is switched to the calibration mode, the controller 20 gives previously-memorized patch data and a printing order to the printer 22 to output a recording medium an image corresponding to the patch data is formed on. The recording medium an image corresponding to the patch data is formed on is compared with a calibration sheet. The calibration sheet configures a correction sheet in this embodiment. In this embodiment, the printer 22 outputs two calibration sheets for process color and white.

The controller 30 makes the scanner 24 optically read the two calibration sheets to obtain read data. The controller 30 obtains a density of an area where an image corresponding to the patch data is formed, and produces gradation correction data (including a gradation correction parameter for each color) from the density. The controller 30 registers the produced gradation correction data, e.g., in the printer 22, and in such instance, the printer 22 corrects a pixel value of image data to print when it receives image data to print. The image forming system 10 in FIG. 1 enables the printer 22 to produce images having stable image density, preventing the printer from deteriorating in image density.

(Outline of Producing Gradation Correction Data)

Figure 2A:
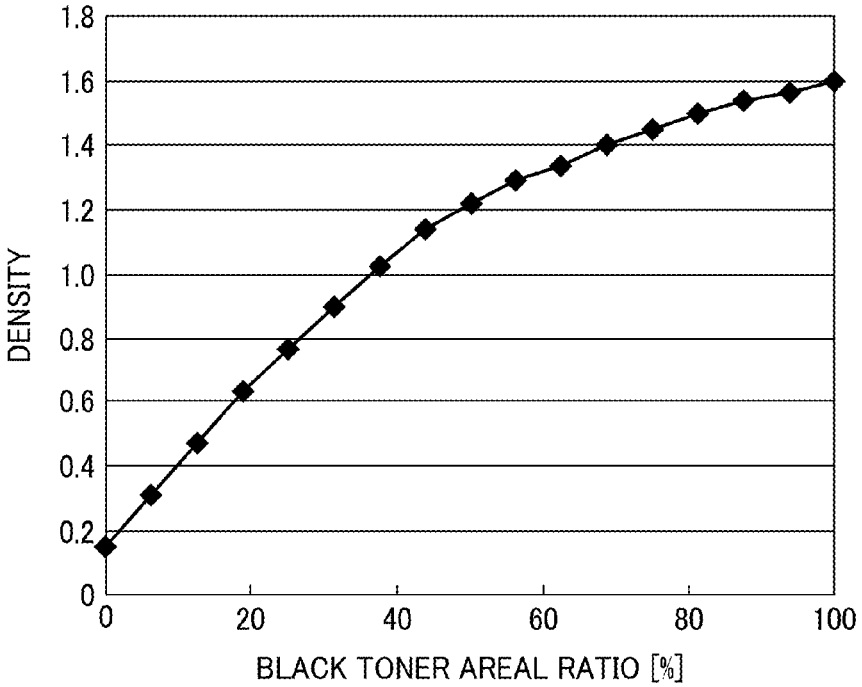
FIG. 2A is a diagram showing a relationship between an areal ratio and a density of a black toner.

FIG. 2A is a diagram showing a relationship between an areal ratio and a density of a black toner when measuring a density of patch data on a white recording medium. The patch data are image data for the printer 22 to print a calibration sheet having plural patch areas to be calibrated. The density of the patch area is to be detected.

When an ordinary process color calibration is made, each of the plural patch areas is formed of any one of the colors C, M, Y and K and has a gradation value different from each other. For example, plural patch areas having, but are not limited to, 17 different gradation values 0, 16, 32, 48, 64, 80, 96, 112, 128, 143, 159, 175, 191, 207, 223, 239 and 255 are formed on the calibration sheet for each of the colors C, M, Y and K.

The image forming system 10 reads density information of each of the patch areas of the calibration sheet to obtain a diagram in FIG. 2A showing a relationship between an areal ratio and a density. The gradation value multiplied by 100/255 is a toner areal ratio and the density information is obtained to see a current status of the printer 22. The image forming system 10 produces a gradation correction for each color on the basis of a diagram of the density relative to the toner areal ratio of each color.

Figure 2B:
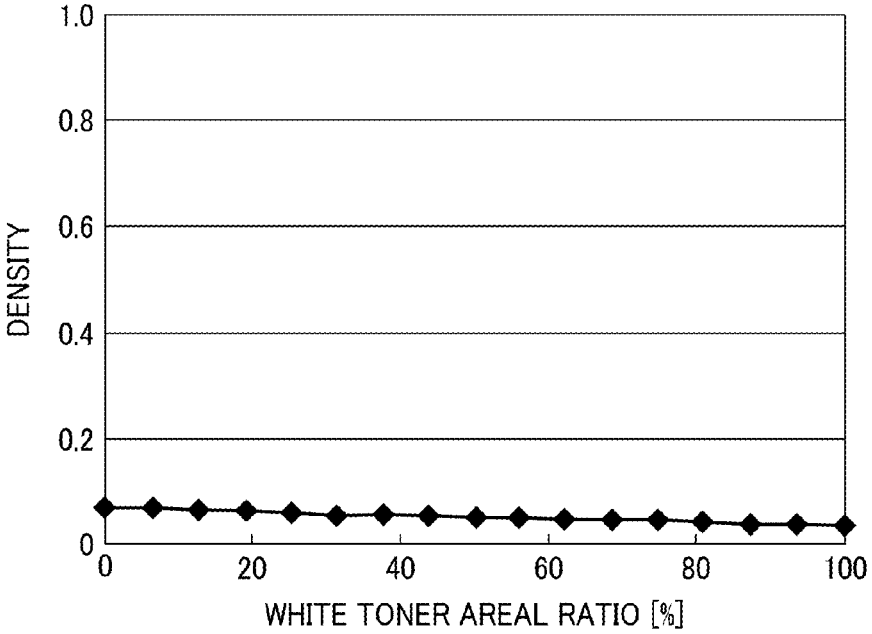
FIG. 2B is a diagram showing a relationship therebetween of a white toner.

FIG. 2B is a diagram showing a relationship between an areal ratio and a density of a white toner when measuring with the same patch data as those of ordinary process colors, using a white recording medium. When calibration of a white toner is made, a case where a calibration sheet is produced using a typical white paper as a recording medium with the same patch data as those of ordinary process colors is explained.

A transfer paper is white and has almost same density as that of a white toner. Therefore, even when the density is measured, the density relative to the toner areal ratio has almost no variation as shown in FIG. 2B. When the white toner has higher whiteness than the transfer paper, the density slightly lowers as the areal ratio increases occasionally. Therefore, it is difficult to produce a gradation correction date for correcting a white toner by the same method for the colored process colors from a diagram of a density relative to a white toner areal ratio using a white recording medium.

Figure 3A:
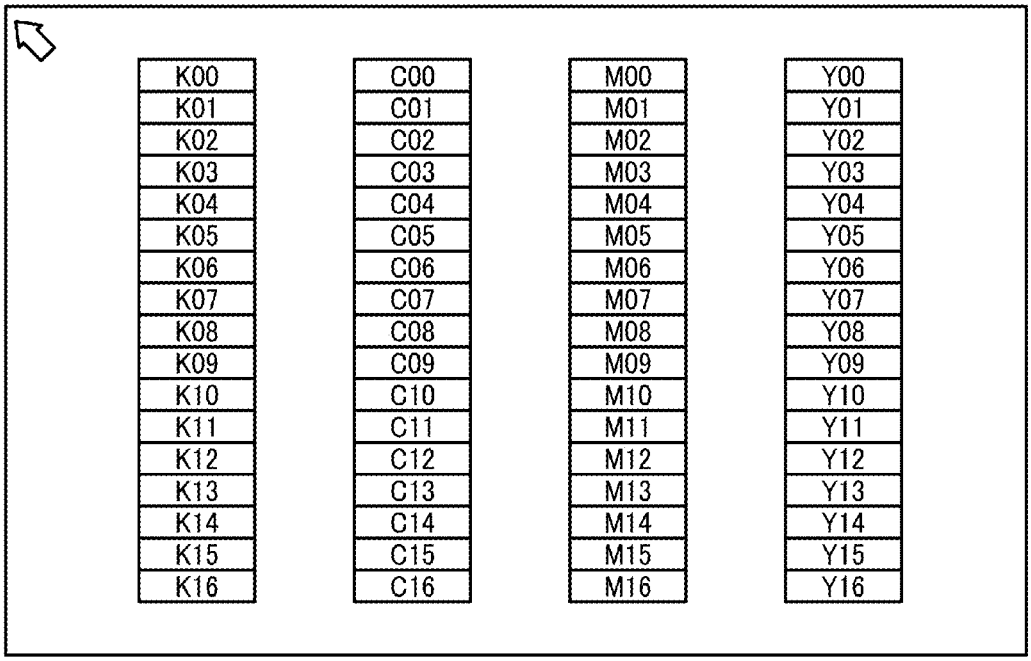
FIG. 3A is an example of a calibration sheet for a process color used in the first embodiment.
Figure 3B:
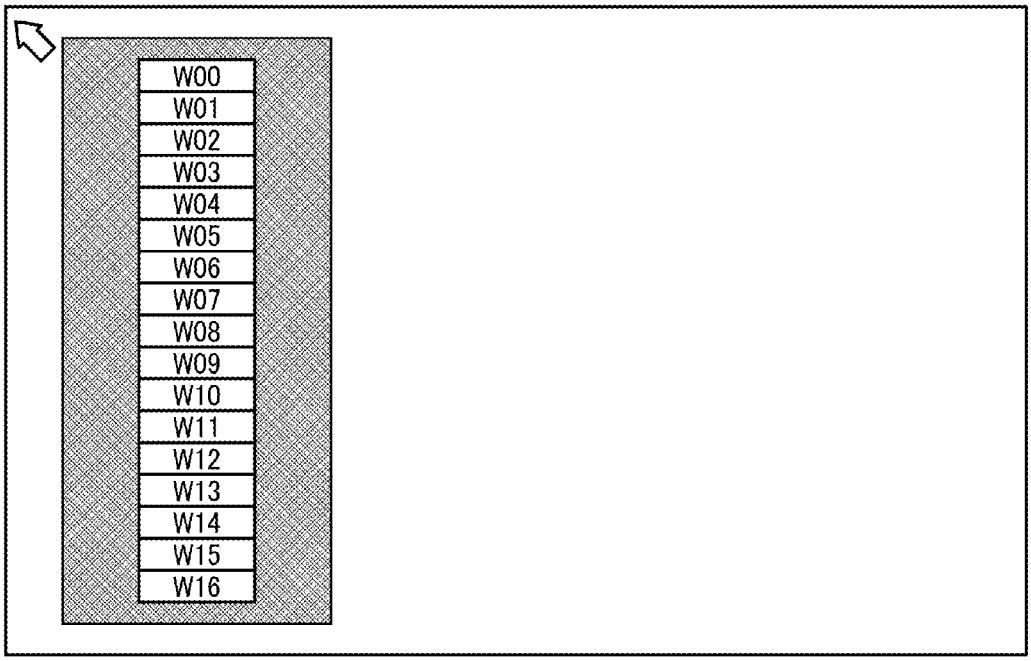
FIG. 3B is an example thereof for a white color used therein.

FIG. 3A is an example of a calibration sheet for a process color used in the first embodiment, and FIG. 3B is an example thereof for a white color used therein. The image forming system 10 in this embodiment executes white toner calibration by the combination of the two calibration sheets in FIGS. 3A and 3B. The controller 30 in the image forming system 10 makes the printer 22 output a calibration sheet for a process color in FIG. 3A, and then a calibration sheet for white color in FIG. 3B.

FIG. 3A is an example of a calibration sheet for a process color. Plural patch areas having 17 different gradation values, i.e., 0, 16, 32, 48, 64, 80, 96, 112, 128, 143, 159, 175, 191, 207, 223, 239 and 255 for black are formed on K00 to K16. Similarly, plural patch areas for cyan, magenta and yellow are formed on C00 to C16, M00 to M16 and Y00 to Y16 respectively.

In this embodiment, after the process color calibration is made using the calibration sheet in FIG. 3A, white color calibration is made using the calibration sheet for a white toner in FIG. 3B.

The calibration sheet for white in FIG. 3B includes 17 patch areas W00 to W16 and a circumferential area formed with a black toner. The calibration sheet for white is produced as follows. First, in a first fixing process, a first layer is formed with a black toner on an area (including 17 patch areas) larger than all of the 17 patch areas on a recording medium. Next, in a second fixing process, a second layer including the 17 patch areas W00 to W16 is formed on an area overlapping the first layer with a white toner.

When the scanner 24 is used as a density measurer, an area of the first layer formed with a black toner is larger than the 17 white patch areas. Namely, a circumferential area is formed around the 17 white patch areas by a black toner. This is because, when the calibration sheet is read by the scanner 24, the circumferential area having high reflectance receives scattered light has higher reflectance than when measured by true black back.

When the 17 patch areas W00 to W16 are located in order from WOO, although depending flare properties of the scanner 24, the circumferential black toner area has a width not less than a horizontal width of the patch area WOO and is formed at right and left sides of the respective patch areas. Further, the circumferential black toner area has a length not less than a vertical length of the patch area W00 and is formed at upside of the patch area W00 and downside of the patch area W16.

The locations of the plural gradation patch areas for a white toner in FIG. 3B (W00 to W16) preferably overlap the plural gradation patch areas in the calibration sheet for a process color which is a colored toner (black toner in this case) fixed below (K00 to K16). The location of the calibration patch for a black toner in FIG. 3A is overlapped with the black toner area which is the lowermost layer. The sheet in FIG. 3B is made using the calibration result of a colored toner to decrease influence of the density variation in the surface as small as possible.

For example, image data having 80% gradation (gradation value 204) are used to form a first layer of a black toner. Data of 17 different gradation values, i.e., 0, 16, 32, 48, 64, 80, 96, 112, 128, 143, 159, 175, 191, 207, 223, 239 and 255 are used to form a second layer including the 17 patch areas W00 to W16 with a white toner as data for a process color.

However, not only image data for forming a uniform area by 80% with a black toner, but also image data having uniform gradation of 50%, 60%, 70%, 90% and 100% may be used to form the first layer. In addition, other toners besides a white toner such as C, M and Y may be used to form the first layer. Further, data for forming the second layer with a white toner are not limited to the above gradation values, either.

The calibration sheet may include a mark indicating a standard position such as an arrow in FIGS. 3A and 3B. The scanner 24 sets a reading position on the basis of this mark when reading a calibration sheet.

Figure 4:
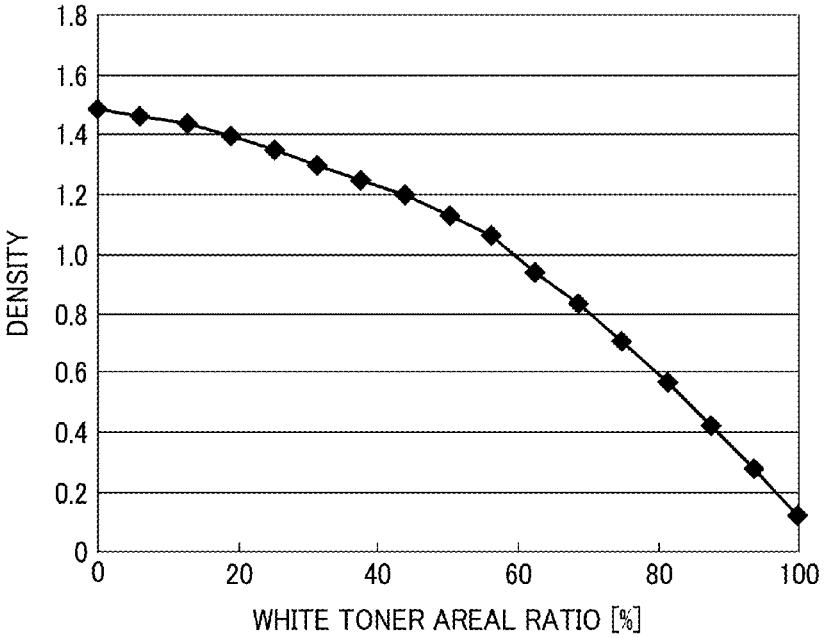
FIG. 4 is a diagram showing results of densities of patch areas measured by a scanner from the calibration sheet in FIG. 3B in the first embodiment.

FIG. 4 is a diagram showing results of densities of patch areas measured by a scanner from the calibration sheet in FIG. 3B. In FIG. 3B, the patch areas having gradational gradation values with a white toner are overlapped with areas of 80% of with a black toner. Therefore, the measurement result of the patch area WOO having an areal ratio of 0% with a white toner is a density of 80% with a black toner. The higher the areal ratio of a white toner, the lower the density.

Properties in FIG. 4 are data in standard engine status, and specific values are conveniently exemplified to explain and variable as time passes. Namely, 80% with a black toner is not always a density of 1.49. 85% is occasionally a density of 1.49 as well.

The first layer with a colored toner has a stable density by outputting a calibration sheet in FIG. 3B reflecting the result of the calibration in FIG. 3A. The image forming system 10 produces gradation correction data for a white toner on the basis of the diagram of density relative to an areal ratio of a white toner. Then, discrepancy of density from standard in FIG. 4 is thought variation of a white toner and calibration is made.

(Hardware Configuration)

Figure 5:
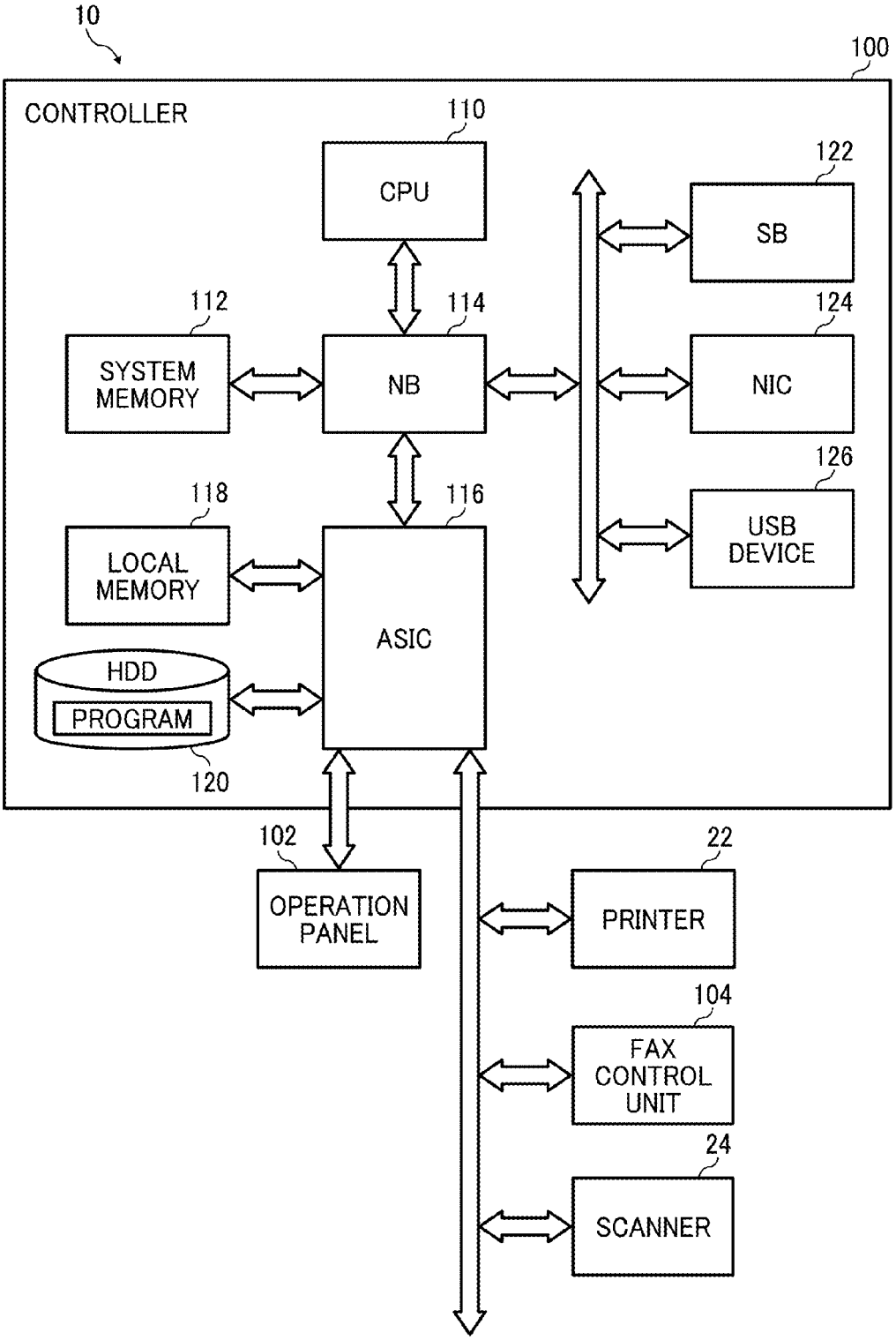
FIG. 5 is a hardware configuration of a combined apparatus including the image forming system of the first embodiment.

FIG. 5 is a hardware configuration of a combined apparatus including the image forming system 10. The image forming system 10 includes a controller 100, an operation panel 102, a fax control unit 104, a printer 22 and a scanner 24.

The controller 100 include a CPU 110, a system memory 112, a north bridge (NB) 114, ASIC (Application Specific Integrated Circuit) 116, a local memory 118, a HDD 120, a south bridge (SB) 122, a NIC (Network Interface Card) 124 and a USB (Universal Serial Bus) device 126.

The CPU 110 controls the whole of the multi-function image forming system 10, and activates a process on OS (Operating System) to execute the system. The system memory 112 is a memory for plotting. The NB 114 is a bridge. ASIC 116 is an IC for image processing application having a hardware element for image processing. The local memory 118 is a memory used for copy image buffer and code buffer. The HDD 120 is an auxiliary storage storing image data, document data, programs, font data, etc.

The SB 122 is a bridge for connecting a PCI (Peripheral Component Interconnect) bus with ROM and circumferential devices. The NIC 124 is an interface apparatus connecting the multi-function image forming system with network. The USB device 126 is an interface in accordance with USB standard.

The operation panel 102 receives an input operation from an operator and displays for the operator. A physical key board is located around the operation panel 102. Setting the toner consumption when executing calibration is preferably instructed from the operation panel 102. The instruction is transmitted to the CPU 110 and a calibration sheet in accordance with the instruction is printed from the printer 22. The fax control unit 104 connects with public communication network through NCU (Network Control Unit), and receives and transmits facsimiles according to a communication protocol correspondent to, e.g., G3 and G4 standard facsimiles.

The printer 22 forms one page of image by one on the basis of print job data including patch data or image data read by the scanner 24, and transfers the image onto a recording medium. The printer 22 corresponds to the printer 22 in FIG. 1. In this embodiment, the printer 22 prints an image correspondent to patch data on a recording medium and outputs a calibration sheet.

The scanner 24 converts a recording medium placed on a contact glass into digital data having predetermined resolution to produce image data. The scanner 24 corresponds to the scanner 24 in FIG. 1. In this embodiment, the scanner 24 reads a calibration sheet to produce read data, and measure density information thereof.

(Functional Composition of Controller)

Figure 6:
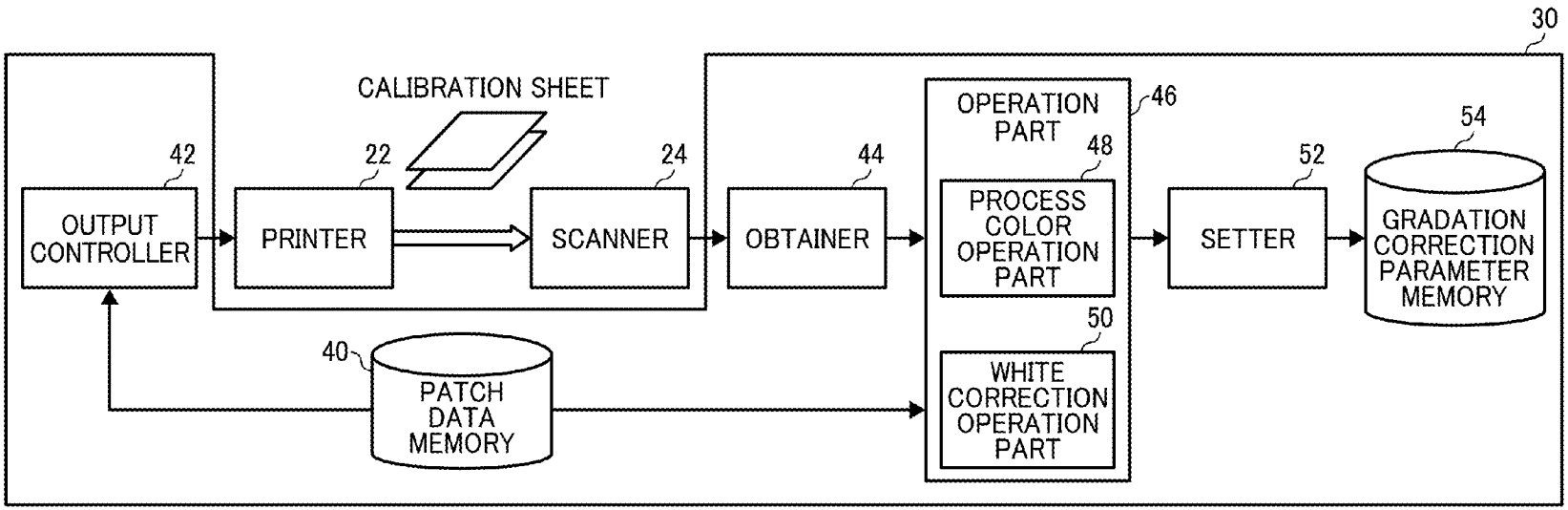
FIG. 6 is a functional block diagram of a controller configuring the image forming system of the first embodiment.

FIG. 6 is a functional block diagram of a controller 30 configuring the image forming system 10 of the first embodiment. FIG. 6 shows the printer 22 and the scanner 24 as well. The controller 30 includes a patch data storage unit 40, an output controller 42, an obtainer 44, an operation part 46, a setter 52 and a gradation correction parameter storage unit 54.

The patch data storage unit 40 is formed of, e.g., memories 112, 118 and a storage such as ROM or a HDD 120. The patch data storage unit 40 stores patch data which is image data for outputting two kinds of calibration sheets.

The output controller 42 is activated, e.g., when a CPU 110 executes a program. The output controller 42 gives the printer 22 patch data stored in the patch data storage unit 40 to output a calibration sheet. Namely, the output controller 42 makes the printer 22 output a calibration sheet for a process color and that for white. The output controller 42 configures an output control means in this embodiment.

The obtainer 44 is activated, e.g., when a CPU 110 executes a program. The obtainer 44 makes the scanner 24 optically read a calibration sheet and receives the read image data. The obtainer 44 configures a density obtaining means obtaining a density of each of plural patch areas formed on a calibration sheet in this embodiment.

The operation part 46 is activated, e.g., when a CPU 110 executes a program. The operation part 46 corrects gradation of CMYK and white on the basis of a density of each of the plural patch areas obtained from a calibration sheet by the obtainer 44, and operates a gradation correction parameter. The operation part 46 configures a correction means in this embodiment.

The operation part 46 specifically includes a process color correction operation part 48 and a white correction operation part 50.

The process color correction operation part 48 corrects gradation on the basis of a density of each of the plural patch areas obtained from a calibration sheet for process colors by the obtainer 44, and operates a gradation correction parameter of process color toners (C, M, Y and K). The white correction operation part 50 corrects gradation on the basis of a density of each of the plural patch areas obtained from a calibration sheet for white by the obtainer 44, and operates a gradation correction parameter of a white toner. The process color correction operation part 48 and the white correction operation part 50 configure a colored coloring material correction means and a white coloring material correction means respectively in this embodiment.

The setter 52 is activated, e.g., when a CPU 110 executes a program. The setter 52 registers the resultant gradation correction parameters of the process color and white toners in the gradation correction parameter storage unit 54. The setter 52 configures a setting means in this embodiment.

The gradation correction parameter storage unit 54 is formed of, e.g., memories 112, 118 and a storage such as ROM or a HDD 120. The gradation correction parameter storage unit 54 stores the gradation correction parameter registered by the setter 52. The gradation correction parameter stored in the gradation correction parameter storage unit 54 is referred to correct gradation of image data given to the printer 22 when printing since then.

The printer 22 may hold the gradation correction parameter. In this case, the gradation correction parameter storage unit 54 is activated by a storage of the printer 22. In addition, the gradation correction parameter may be held by a device (printer) driver of the multi-function printer. In this case, an image processor such as a PC activated by a device driver includes the gradation correction parameter storage unit 54.

The output controller 42, the obtainer 44, the operation part 46 and the setter 52 are activated, e.g., when the CPU 110 executes programs as mentioned above. However, a part or all of them may be activated by a programmable device circuit such as ASIC circuits and FPGA (Field-Programmable Gate Array).

(Method of Producing Gradation Correction Parameter)

Figure 7:
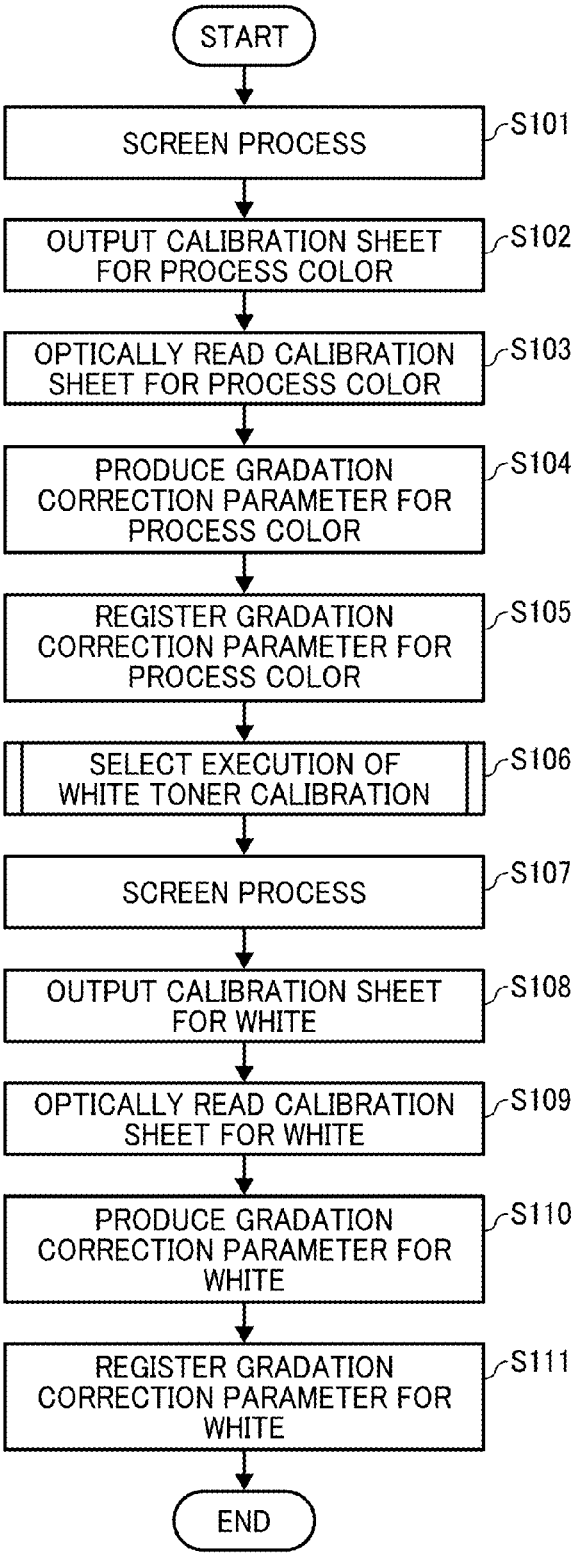
FIG. 7 is a flowchart showing a calibration process executed by the image forming system of the first embodiment.

A method of producing a gradation correction parameter for a white toner is specifically explained. FIG. 7 is a flowchart showing a calibration process executed by the image forming system 10 of the first embodiment. The procedure in FIG. 7 starts with STEP S100 when a user switches to a calibration mode.

In STEP S101, the image forming system 10 does screen process on the basis of patch data for process colors.

First, patch data are explained. The patch data is image data printed on a recording medium having a specified size such as A4 size paper. The patch data are image data for forming lines of a series of path areas (patch lines) varying in gradation values as well as shown in FIG. 3A. The gradation value does not need to uniformly increase between patch areas. The gradation value may increase such that lightness difference, density difference or other uniformly increases therebetween when a calibration sheet is printed.

Figures 8, 9:
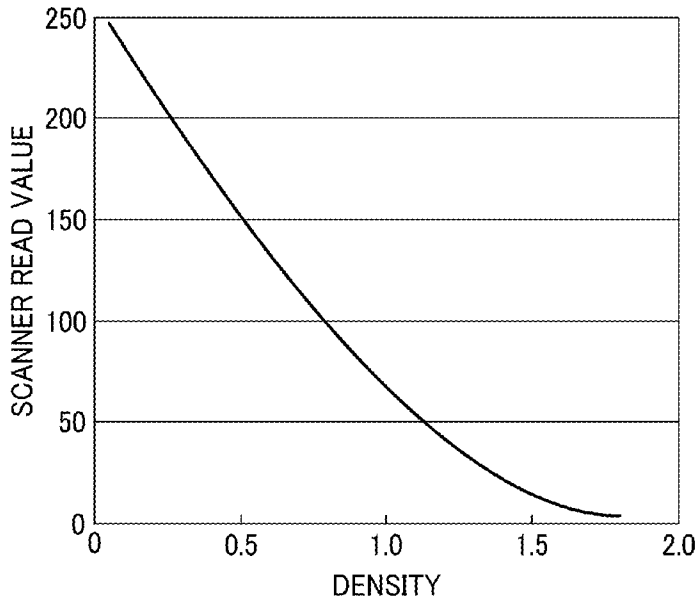
FIG. 8 is an example of a gradation value of a patch area for a process color.
FIG. 9 is a diagram showing a relationship between a density and scanner read value.

FIG. 8 is an example of a gradation value of a patch area for a process color. As mentioned above, gradation values from K00 to K16 constituting a series of patch lines do not need to uniformly increase. FIG. 8 shows only an example of a patch for black toner calibration. As for cyan, magenta and yellow, the gradation values of black in FIG. 8 may be exchanged with those of C, M or Y.

The gradation value, i.e., a pixel value of image data is not particularly limited, but 0 or an integer not greater than 255. The larger the value, the larger the density. As for the read data read by the scanner 24, the smaller the value, the larger the density because the density becomes lower as reflectance becomes larger.

The calibration sheet is not necessarily a sheet on which the gradation value designated by the patch data is printed as it is, and may be an output of the patch data subjected to the gradation correction process using the gradation correction parameter produced by the image forming system 10 last time.

In the screen process STEP S101, the output controller 42 reads patch data for a process color from the patch data storage unit 40. The output controller 42 analyzes the patch data for process color into color components C, M, Y, K and white, and do a halftone process determining output gradation value from a relation between a serial gradation value and a threshold per each one pixel.

The halftone process converts multi-value (e.g. 8 bit) image data into a small-value (e.g., 2 bit) image data using a screen having a specific shape such as dot while globally keeping density. Dither methods or random dither methods are known as the halftone process. The output controller 42 subjects patch data to a halftone process with dither methods and outputs the processed patch data. An output gradation value of image data after subjected to halftone process is a small value such as four values 0, 85, 170 and 255.

In FIG. 7, at STEP S102, the image forming system 10 outputs a calibration sheet for a process color. The output controller 42 requests the printer 22 to print patch data for a process color subjected to halftone process. The printer 22 determines which dot to output from 0, 85, 170 or 255 for each pixel and outputs a calibration sheet for a process color on which an image is formed at the determined value.

At STEP S103, the image forming system 10 optically reads a calibration sheet for a process color. A user places a calibration sheet for a process color output at STEP S102 on a contact glass of the scanner 24 and executes a specific operation such that the scanner 24 optically reads the calibration sheet. An original first read in a calibration mode is a calibration sheet for a process color, and it is essential that the calibration sheet is placed at a right position relative to a standard position on the contact glass. The sheet may manually be placed in the contact glass by a user or the sheet output from the printer 22 may directly be placed at a reading position of the scanner 24.

The scanner 24 scans a calibration sheet to obtain contrast information thereof. The contrast information is represented by. e.g., 600 dpi and 8-bit RGB data. The contrast information obtained by the scanner 24 may properly be subjected to shading correction. The obtainer 44 abstracts contrast information of plural pixels (e.g., 600 dpi 128×128 pixels) in a specific areas around the center for each of serial patch areas of each color X00 to X16 (X=K, C, M and Y) from the contrast information obtained from the scanner 24. The obtainer 44 calculates an average of contrast information of plural pixels in a specific area for one patch area, and the average is a measured value of contrast information of the patch area. The contrast information of pixels around the center of the patch area are abstracted not to receive influence of the other adjacent patch areas. In addition, when a calibration sheet is shifted from the normal position of the contact glass, deterioration of reading preciseness can be prevented.

A calibration sheet for a black toner has an achromatic color. Therefore, the obtainer 44 obtains an average of specific areas located around the center of the patch area of green channel data of the scanner 24 as a measured value of contrast information of the patch area. As for cyan, magenta yellow toners, an average of specific areas around the center of patch areas of their complementary color channels, i.e., R, G and B channels is obtained as a measured value of contrast information of the patch area.

At STEP S104, the image forming system 10 produces a gradation correction parameter of a process color toner. The gradation correction parameter is produced therein as follows.

FIG. 9 is a diagram showing a relationship between a density of a black toner and scanner read value when the scanner 24 reads a calibration sheet. First, the operation part 46 stores a table showing a relationship between a density of a black toner and scanner read value. This table is made on previous experiments. The operation part 46 converts the contrast information (scanner read value) obtained by the obtainer 44 into a density for each of the patch areas K00 to K16 in reference to the table showing a relationship between a density and scanner read value. Hereinafter, the measured value of a density read by the scanner 24 represents a density converted from the relation in FIG. 9. This is the same for cyan, magenta and yellow toners.

Figures 10A, 10B:
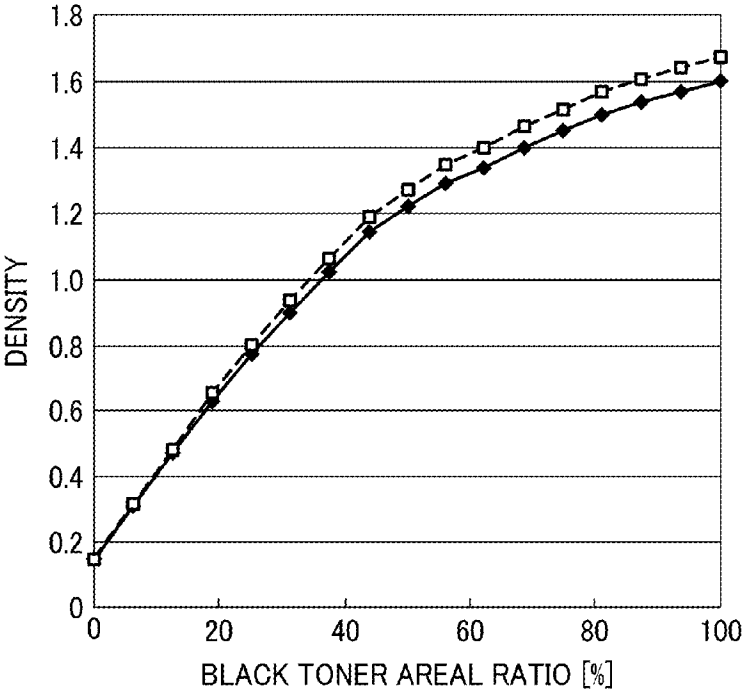
FIGS. 10A and 10B are a diagram and a table respectively showing a relationship among a black toner areal ratio, an expected value of density and a measured value of density read by a scanner.

A white square □ in FIG. 10A represents a measured value of a density read by the scanner 24 in each of the patch areas K00 to K16 (black is explained as a representative). A black diamond ♦ in FIG. 10A represents an expected value of a density in each of the patch areas K00 to K16. Relationships among black toner areal ratio and, expected value of density and a measured value are shown in FIG. 10B.

Figures 11, 12:
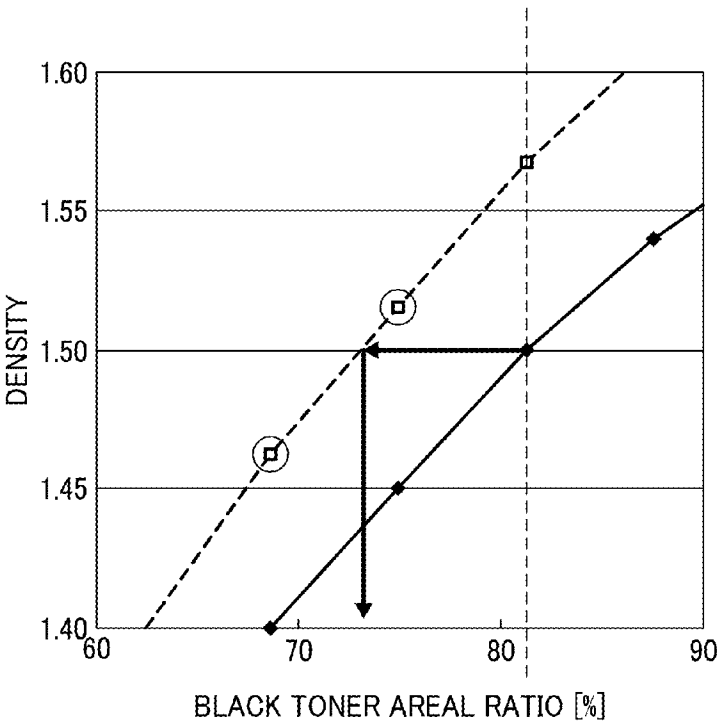
FIG. 11 is a diagram for explaining a method of producing a gradation correction parameter of the process color in the first embodiment.
FIG. 12 is an example of a gradation value of a patch area for a white color.

FIG. 11 is a diagram foe explain a method of producing a gradation correction parameter of the process color in the first embodiment. A dotted line connecting white squares □ in FIG. 11 is a diagram showing a relationship between a measured value of density and a black toner areal ratio. A solid line connecting black diamonds ♦ represents a diagram showing a relationship between an expected value of density and a black toner areal ratio.

When the measured value and the expected value are the same, no correction is ideally needed. However, in FIG. 11, at a point where the black toner areal ratio represented by a dotted line is 81%, the expected value of density is 1.50 and the measured value thereof is 1.568 which are not the same. This is due to aging of components and assembling of the printer 22. The density is higher than expected, and the expected density needs less toner.

The operation part 46 calculates a black toner areal ratio to realize density using linear interpolation and a gradation correction parameter of the density. Namely, the operation part 46 detects a value lower than the expected value and a value higher than that among the adjacent measured values. Two points where the black toner areal ratio is 69% and 75% fall within the scope. A liner interpolation is made between the two points to calculate a black toner areal ratio relative to the expected value of density. When specifically calculated, a solution of 73.1% is obtained. Namely, to an image needing areal ratio data of 81% as a black toner, a black toner having less areal ratio of 73.1% is given to correct density variation due to aging and obtain an expected gradation. The areal ratio data is converted into 8-bit gradation data when multiplied by 255/100. The gradation values relevant to 73.1% and 81% are 186 and 207 respectively.

The operation part 46 produces a conversion table including discrete 17 point gradation values relevant to the expected density of each patch area. Further, the operation part 46 moderately interpolate 16 intervals among the 17 points in the conversion table using spline interpolation to produce a gradation correction parameter of every one gradation from 0 to 255. Similarly, the operation part 46 produces a gradation correction parameter for each of cyan, magenta and yellow.

At STEP S105, the image forming system 10 registers the produced gradation correction parameter of each of process color toners C, M, Y and K. The gradation correction parameter of the process color toner is registered as follows.

When the gradation correction parameter is produced by the operation part 46, the setter 52 stores the produced gradation correction parameter stores in the gradation correction parameter storage 54. When the printer 22 does the gradation correction process, the gradation correction parameter storage 54 is located in the printer 22. When a driver program does the gradation correction process, the gradation correction parameter storage 54 is located in a storage area of an information processor the driver program is installed in.

The printer 22 or the information processor the driver program is installed in converts a pixel value of each pixel included in image data with the gradation correction parameter and subjects the converted image data to halftone process to print when printing since then. For example, the printer 22 or the information processor the driver program is installed in corrects gradation into gradation value 186 when given with a pixel having a black toner gradation value 207.

Thus, calibration of the process color toner is completed. Then, the results are reflected on K, C, M and Y besides white to continue printing a calibration sheet for a white toner and calibration.

In FIG. 7, at STEP S106, the image forming system 10 selects whether calibration for a white toner is executed. When calibration of the process color toner is completed, an operation screen asking whether calibration for a white toner is continuously executed is displayed on the operation panel 102. When a user selects not to execute, the process is finished. When a user selects to execute, the process proceeds to the next step. A case where a user selects to execute is explained.

At STEP S107, the image forming system 10 does a screen process on the basis of patch data for white. The patch data for white is image data for forming a circumferential area of a black toner having a gradation value realizing a specific areal ration in a first layer, and a line of a series of patch areas (patch line) varying gradation values in a second layer. The gradation value does not need to uniformly increase among patch areas. The gradation value may increase such that lightness difference, density difference or other uniformly increases therebetween.

FIG. 12 is an example of a gradation value of a patch area for a white color. As mentioned above, the gradation values of areas constituting a series of patch lines WOO to W16 do not need to uniformly increase. The circumferential areas of W00 to W16 have gradation values when W value is replaced with 0 in FIG. 12.

A black toner of 80% is printed in a first layer with a standard engine, which equals to a density of 1.49 as a solid line in FIG. 10A. When the above calibration is completed, in compliance with designation of 80% areal ratio, a 72.0% areal ratio data giving a density of 1.49 are allocated. The gradation value 204 for K relevant to an 80% black tone is corrected to 184. Namely, a first layer is formed with a black toner gradation value in accordance with the process color gradation correction result in a calibration sheet for white.

At STEP S107, the following screen process is done, the output controller 42 reads patch data for white from the patch data storage unit 40. The output controller 42 analyzes the read patch data into C, M, Y, K and W color components and does halftone process to successively determine an output gradation value from a relation between the gradation value and a threshold for every one color pixel. The output gradation values of image data after subjected to the halftone process are 4 values such as 0, 85, 170 and 255.

At STEP S108 in FIG. 7, similarly to STEP S102, the image forming system 10 makes the printer 22 output a calibration sheet for white on the basis of the process result of STEP S107. At STEP S109, the image forming system 10 optically reads a calibration sheet for white similarly to S103. As mentioned above, the scanner 24 scans a calibration sheet to obtain contrast information thereof. The obtainer 44 abstracts contrast information of plural pixels in a specific area around the center of each of the serial patch areas W00 to W16 from the obtained contrast information. The calibration sheet for a white toner has an achromatic color. Therefore, the obtainer 44 obtains an average of specific areas located around the center of the patch area of green channel data of the scanner 24 as a measured value of contrast information of the patch area.

At STEP S110, the image forming system 10 produces a gradation correction parameter of a white toner. The gradation correction parameter is produced therein as follows.

Similarly to STEP S104, first, in reference to a table showing a relation between density and scanner read value, the contrast information (scanner read value) obtained by the obtainer 44 is converted into density.

Figures 13A, 13B:
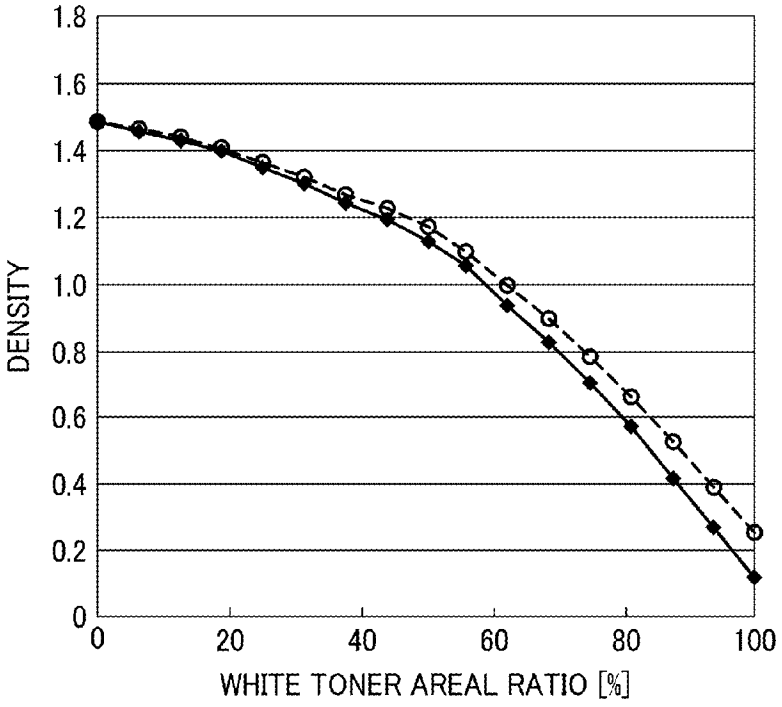
FIGS. 13A and 13B are a diagram and a table respectively showing a relationship among a white toner areal ratio, an expected value of density and a measured value of density read by a scanner.

FIGS. 13A and 13B are a diagram and a table respectively showing a relationship among a white toner areal ratio, an expected value of density and a measured value of density read by a scanner.

A white circle ○ in FIG. 13A represents a measured value of a density read by the scanner 24 in each of the patch areas W00 to W16. A black diamond ◆ in FIG. 13A represents an expected value of a density in each of the patch areas W00 to W16. Relationships among white toner areal ratio and, expected value of density and a measured value are shown in FIG. 13B.

First, data of a white toner areal ratio of 0% in FIG. 13A is focused. A process color calibration is made just before, and the expected value and the measured value are ordinarily the same. Discrepancies thereof for other densities are due to variation of white toner density level.

Figure 14:
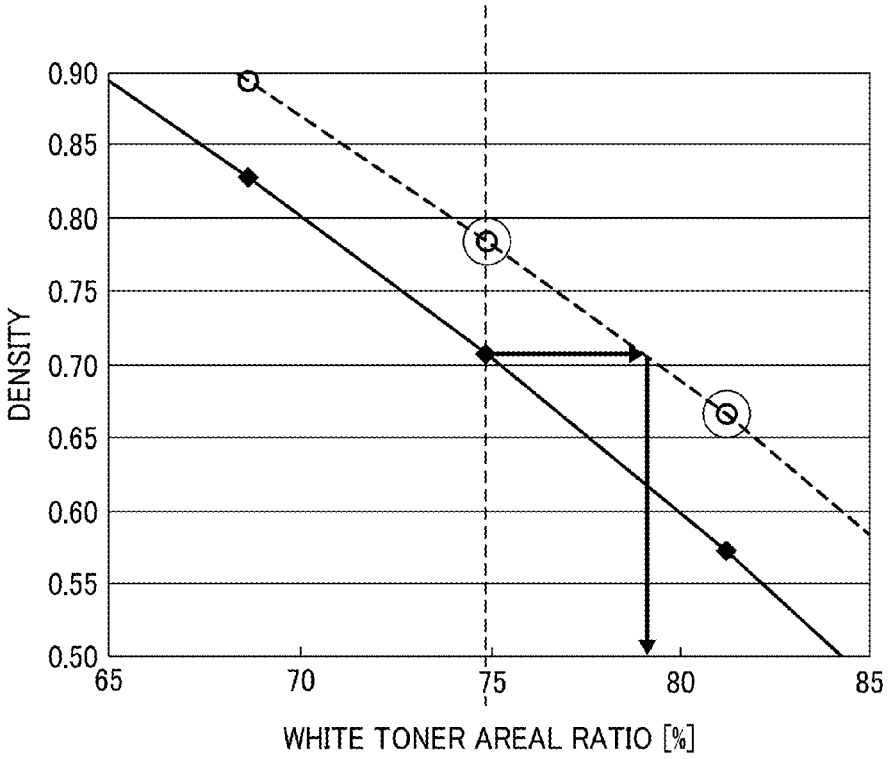
FIG. 14 is a diagram for explaining a method of producing a gradation correction parameter of the white color in the first embodiment.

FIG. 14 is a diagram foe explain a method of producing a gradation correction parameter of the white color in the first embodiment. A dotted line connecting white circles ○ in FIG. 14 is a diagram showing a relationship between a measured value of density and a white toner areal ratio. A solid line connecting black diamonds ♦ represents a diagram showing a relationship between an expected value of density and a white toner areal ratio.

When the measured value and the expected value are the same, no correction is ideally needed. However, in FIG. 14, at a point where the black toner areal ratio represented by a dotted line is 75%, the expected value of density is 0.71 and the measured value thereof is 0.784 which are not the same. This is due to aging of components and assembling of the printer 22, and the expected density needs whiter toner.

The operation part 46 calculates a white toner areal ratio to realize density using linear interpolation and a gradation correction parameter of the density. Namely, the operation part 46 detects a value higher than the expected value and a value lower than that among the adjacent measured values. Two points where the white toner areal ratio is 75% and 81% fall within the scope. A liner interpolation is made between the two points to calculate a white toner areal ratio relative to the expected value of density. When specifically calculated, a solution of 79.0% is obtained. Namely, to an image needing areal ratio data of 81% as a white toner, a white toner having larger areal ratio of 79.0% is given to correct density variation due to aging and obtain an expected gradation. The gradation values relevant to 79.0% and 75% are 202 and 191 respectively.

The operation part 46 produces a conversion table including discrete 17 point gradation values relevant to the expected density of each patch area. Further, the operation part 46 moderately interpolate 16 intervals among the 17 points in the conversion table using spline interpolation to produce a gradation correction parameter of every one gradation from 0 to 255.

At STEP S111 in FIG. 7, the image forming system 10 registers the produced gradation correction parameter of a white toner. When the gradation correction parameter is produced by the operation part 46, the setter 52 stores the produced gradation correction parameter stores in the gradation correction parameter storage 54. The printer 22 or the information processor the driver program is installed in converts a pixel value of each pixel included in image data with the gradation correction parameter and subjects the converted image data to halftone process to print when printing. For example, the printer 22 or the information processor the driver program is installed in corrects gradation into gradation value 202 when given with a pixel having a white toner gradation value 191.

At STEP S112, the image forming system 10 finished processing.

(Printing Process Using Gradation Correction Parameter)

The image forming system 10 does gradation correction process using a gradation correction parameter for image data when printing ordinary image data as follows when the above calibration stores process color and white gradation correction parameters in the gradation correction parameter storage 54.

When the image forming system 10 is activated as a multi-functional image forming apparatus in FIG. 5, e.g., the scanner 24 or a fax control unit 104 works as an image inputter inputting image data. CPU 110 executes a program to do gradation correction process to work as a gradation corrector. For example, an interface or the printer 22 connected with ASIC 116 having an engine works as an image output unit outputting image data subjected to gradation correction.

The image inputter inputs each of data equivalent to one pixel. Data equivalent to one pixel of image data are represented by, e.g., an integer of from 0 to 255. The gradation corrector subjects a gradation value of image data input by the image inputter to gamma conversion one pixel by one in reference to the gradation correction parameter. The image output unit outputs the gradation value converted by the gradation corrector one pixel by one. The image data after converted modulates a laser beam to correct density variation as time passes and print color images.

The image forming system 10 produces a gradation correction parameter to correct density variation of a white toner as time passes and form images with stable whiteness.

Further, the image forming system 10 outputs a calibration sheet with a colored toner from an image forming apparatus to obtain density properties of the colored toner on the basis of the result thereof, and further outputs a calibration sheet on which a white toner and a colored toner are overlapped to calculate density properties of the white toner and correct gradation of a white colored material.

For example, gradation can be corrected only with a calibration sheet on which a second layer of white toner overlies a first layer of a colored toner. In that case, calibration cannot be made unless the calibration sheet has a first layer of colored toner having a specific areal ratio, e.g., 100%. As a result, toner consumption in calibration cannot be saved. In this embodiment, the gradation of a white colored material is corrected using a sheet reflecting the gradation correction result of a colored material forming the first layer of a calibration sheet for white. The gradation of a white colored material is corrected using a colored toner having a desired areal ratio for a first layer, and toner consumption in calibration can be saved.

Second Embodiment

In the first embodiment, as a calibration sheet for a white toner, a black toner having an areal ratio of 80% is fixed as a first layer in a standard engine status. However, the areal ratio is not limited to 80%.

Figure 15:
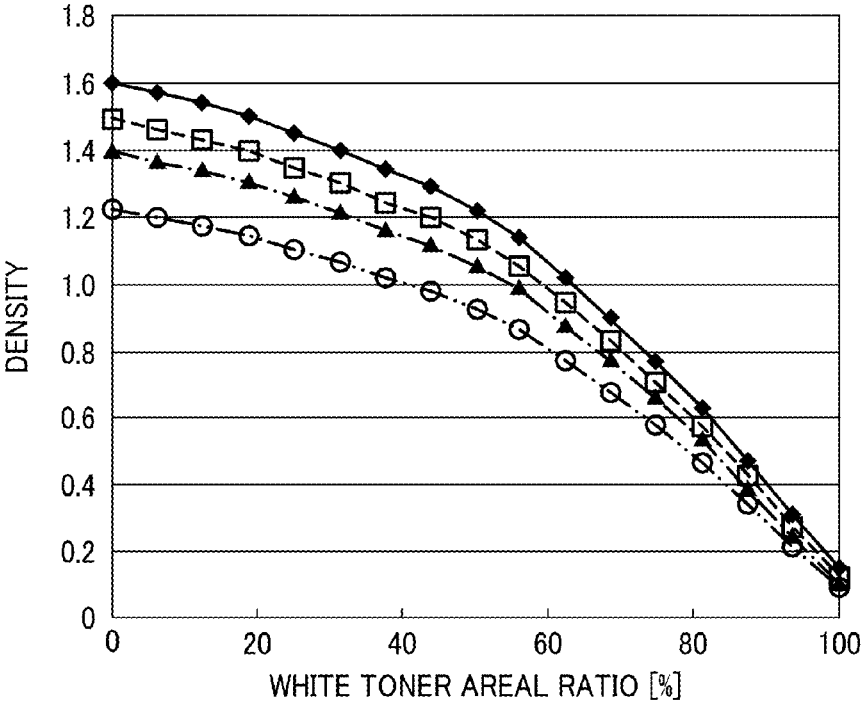
FIG. 15 is a diagram showing a relationship between an areal ratio of the white toner and an expected value of density in a calibration sheet when a black toner having plural areal ratios is the first layer.

FIG. 15 is a diagram showing a relationship between an areal ratio of the white toner and an expected value of density in a calibration sheet when a black toner having plural areal ratios is the first layer. In FIG. 15, when a white toner has an areal ratio of 0%, a black diamond ♦ represents a black toner having an areal ratio of 100%, a white square □ represents a black toner having an areal ratio of 80%, a black triangle ▲ represents a black toner having an areal ratio of 69%, and a white circle ○ represents a black toner having an areal ratio of 50%.

Expected value data of densities relevant to these black toner areal ratios are previously stored, and read out at STEP S110 in FIG. 7. Thus, the white toner calibration is properly executed according to the selected black toner areal ratios.

In terms of toner consumption, the calibration can be made at minimum consumption with a toner having an areal ratio of 50%. However, as shown in FIG. 15, the less the colored toner consumption, the smaller the scope of image density information (dynamic range). For example, when the colored toner has an areal ratio of 80%, about 200 data are available in an areal ratio range of from 0 to 100% of a white toner. When the colored toner has an areal ratio of 50%, about a half of 8 bits (256 gradations), i.e., about 120 gradations are available. The larger the dynamic range (the toner consumption), the higher the preciseness of calibration.

A user does not always need a high-precision white toner calibration. In the second embodiment, the toner areal ratio of the first layer is selectable by a user. An optimal calibration is made reflecting a user's will whether the preciseness or saving toner consumption has priority.

Figure 16:
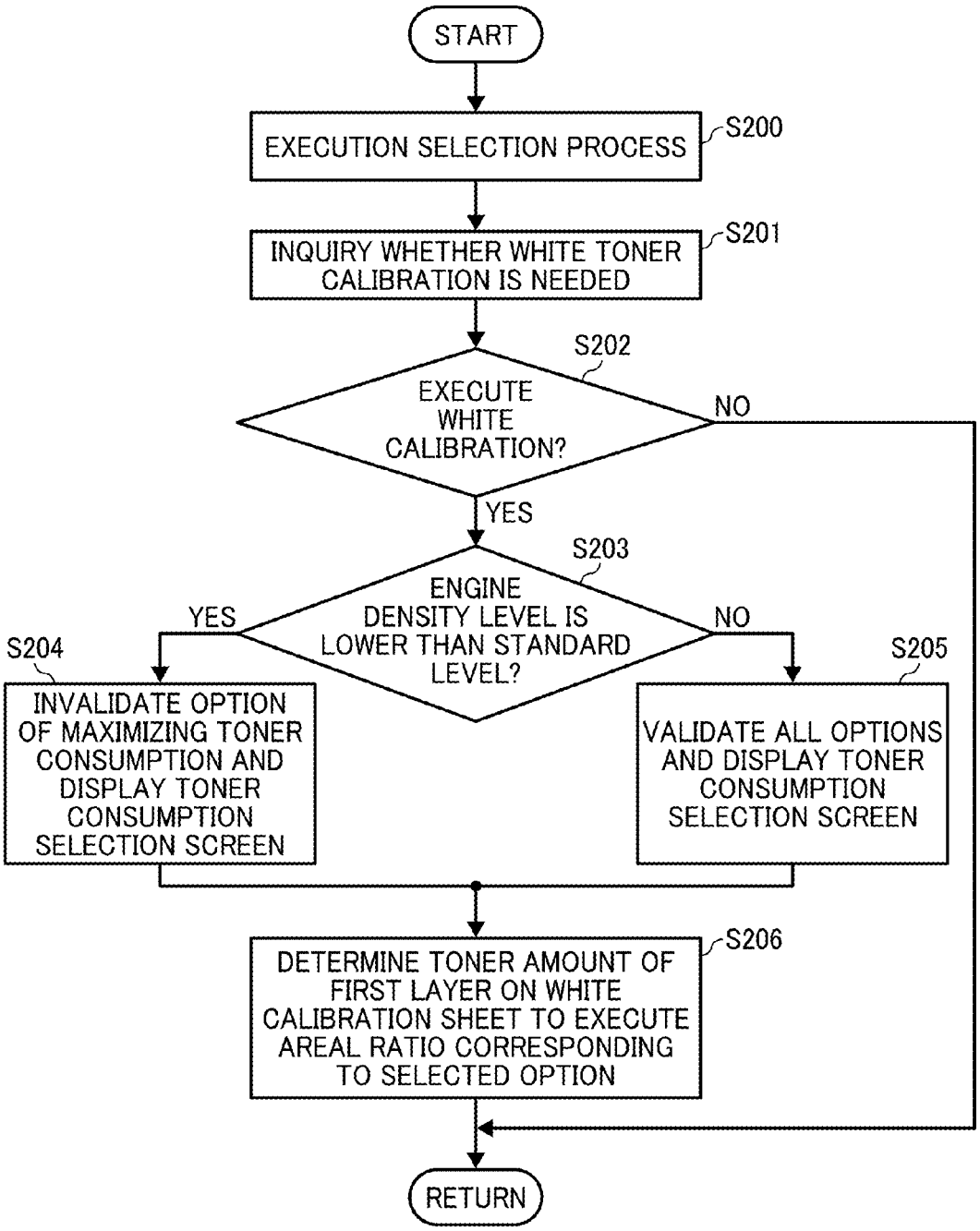
FIG. 16 is a flowchart showing a process of determining whether calibration of the white toner is executed in a second embodiment of the image forming system.

FIG. 16 is a flowchart showing a process of determining whether calibration of the white toner called at STEP S106 in FIG. 7 is executed in a second embodiment of the image forming system 10. The process in FIG. 16 is called at STEP S106 in FIG. 7 in response to finishing of process color calibration, and starts from STEP S200.

AT STEP S201, the image forming system 10 displays a screen asking whether the white toner calibration is continuously executed on the operation panel 102. At STEP S202, the process is branched depending on whether an instruction whether the white color calibration is made on the operation panel. When a user is judged to select not to execute (NO), the process is branched to STEP S207, and finished.

When a user is judged to select to execute (YES) at STEP S202, an operation screen is displayed to make choices on toner consumption needed for further white toner calibration.

Even when the areal ratio of 100% is selected, the black toner calibration is difficult to accord with an expected curve of density when the white toner has an areal ratio of 0% in FIG. 15 if the engine density level is lower than a standard level.

At STEP S203, whether the engine density level is lower than a standard level is judged and the process is branched. Whether the engine density level is lower than a standard level is judged whether a toner used in the first layer at an areal ratio of 100% is lower than a standard level when process color toner calibration is made.

At STEP S203, when the engine density level is judged to be lower than a standard level (YES), the process is branched to STEP S204. At STEP S204, the image forming system 10 displays a toner consumption selection menu, invalidating a choice of maximum toner consumption fixing a toner at an areal ratio of 100% in the first layer so as not to be selected by a user.

Figure 17:
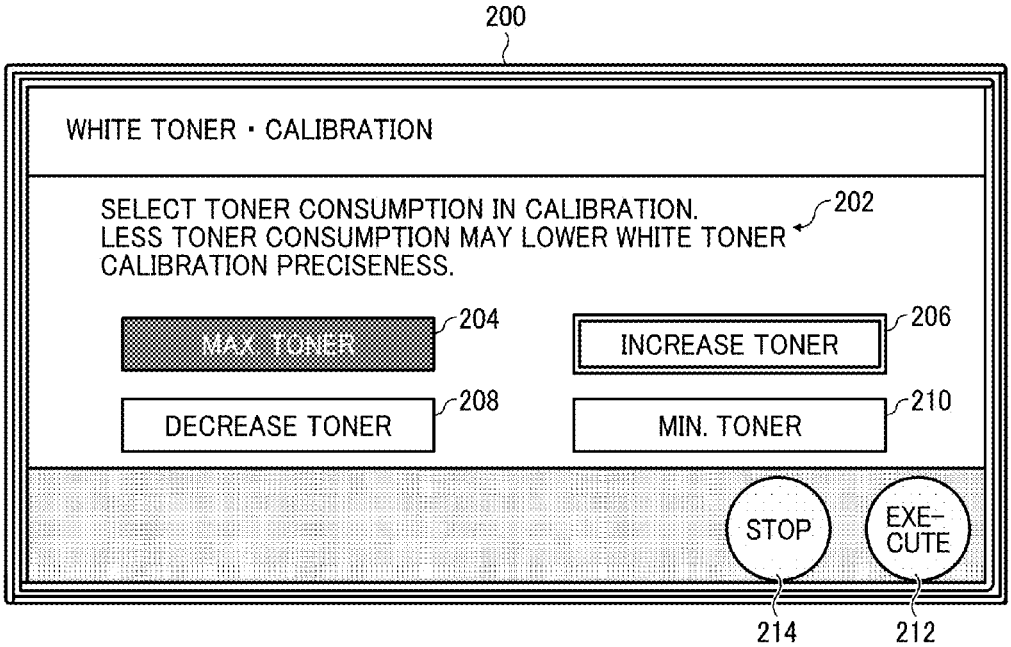
FIG. 17 is an example of toner consumption selection menu displayed on an operation panel in the second embodiment of the image forming system.

FIG. 17 is an example of toner consumption selection menu displayed on the operation panel 102 in the second embodiment of the image forming system 10. A toner consumption selection menu 200 in FIG. 17 includes a message urging selection of toner consumption, toner consumption selection buttons 204 to 210, an execution button 212 and a stop button 214. The toner consumption selection menu configures a designated value receiver obtaining a designated value of the toner consumption used to correct gradation of white colored material. Based on the designated value of toner consumption received through the toner consumption selection menu, a gradation value of a colored material in the first layer of a calibration sheet is determined.

A user can select the toner consumption from 4 stages of from large (204) to small (210). The message 202 may include a warning that the less the toner consumption, the lower the calibration preciseness of a white toner. In the toner consumption selection menu in FIG. 17, the choice of the maximum toner consumption is invalidated and grayed out.

At STEP S203, when the engine density level is judged to be not lower than a standard level (NO), the process is branched to STEP S205. At STEP S205, the image forming system 10 displays a toner consumption selection menu, validating all the choices.

When the toner consumption is selected at STEPS S204 and S205, the process is proceeded to STEP S206. At STEP S206, according to the user's choice through the toner consumption selection menu 200, a black toner amount of the first layer of a calibration sheet for white is determined so as to realize an areal ratio correspondent to the selected choice.

Third Embodiment

The second embodiment has no choice of the maximum toner consumption when the engine density level is low. The third embodiment has a choice of the maximum toner consumption even when the engine density level is low.

Figure 18:
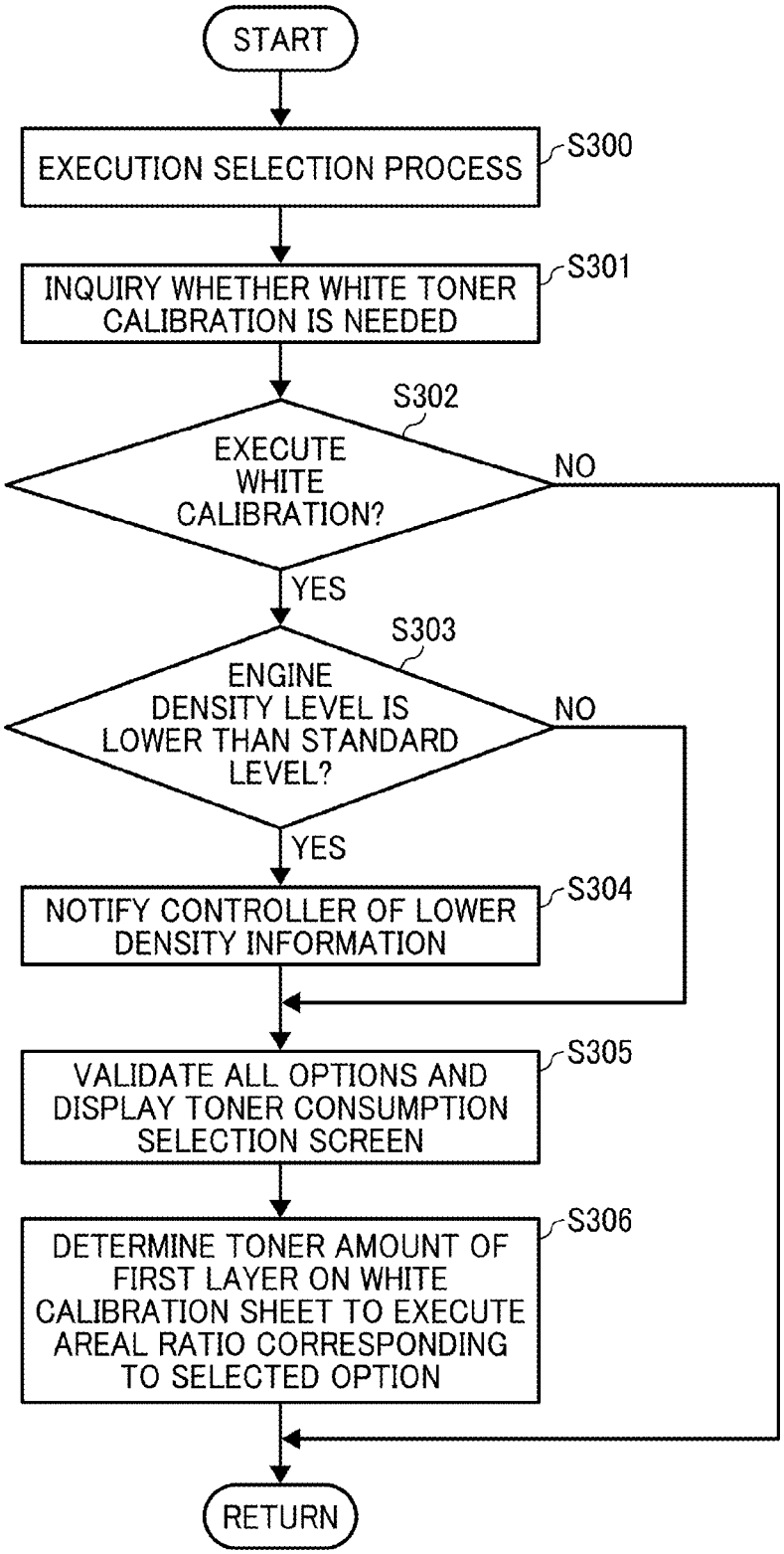
FIG. 18 is a flowchart showing a process of determining whether calibration of the white toner is executed in a third embodiment of the image forming system.

FIG. 18 is a flowchart showing a process of determining whether calibration of the white toner called at STEP S106 in FIG. 7 is executed in a third embodiment of the image forming system 10.

The process in FIG. 18 starts from STEP S300 similarly to the second embodiment. At STEP S301, the image forming system 10 displays a screen asking whether the white toner calibration is continuously executed on the operation panel 102. At STEP S302, the process is branched depending on whether an instruction whether the white color calibration is made on the operation panel. When a user is judged to select not to execute (NO), the process is branched to STEP S307, and finished.

When a user is judged to select to execute (YES) at STEP S302, the image forming system 10 judges whether the engine density level is lower than a standard level and branches the process at STEP 303. At STEP S303, when the engine density level is judged to be lower than a standard level (YES), the process is branched to STEP S304. At STEP S304, the image forming system 10 notifies the controller 30 of low density information notifying the engine density level is lower than a standard level. At STEP S303, when the engine density level is judged to be not lower than a standard level (NO), the process is branched to STEP S305.

In this embodiment, the toner consumption selection menu does not need to gray down a part thereof, and the image forming system 10 displays a toner consumption selection menu, validating all the choices at STEP S305.

When the toner consumption is selected at STEP S305, the process is proceeded to STEP S306. At STEP S306, according to the user's choice through the toner consumption selection menu 200, the image forming system 10 determines a black toner amount of the first layer of a calibration sheet for white so as to realize an areal ratio correspondent to the selected choice. The process is finished at STEP S307.

The controller 30 having received the low density information after the engine density level of the printer 22 is judged to be lower than a standard level further makes calibration after determining the following corrected measured value when the maximum toner consumption is designated.

First, the patch area WOO having a white toner areal ratio of 0% is focused. The patch area WOO having a white toner areal ratio of 0% has a density of black toner 100% that is the maximum consumption regardless of white toner properties. Namely, a difference between a measured value read by the scanner 24 and an expected value in the patch area W00 having a white toner areal ratio of 0% is a variation amount of black toner density. The operation part 46 uniformly corrects measured values of patch areas W01 to W16 having other white toner areal ratios on the basis of the variation amount of density.

Namely, first, the operation part 46 determines a difference between a measured value read by the scanner 24 and an expected value in the patch area WOO having a white toner areal ratio of 0% as a correction amount by the following formula (1).

$$(\text{Correction Amount})=(\text{Measured Value of } W00)-(\text{Expected Value of } W00) \quad (1)$$

The operation part 46 determines a corrected measured value, reducing the correction amount from the measured value read by the scanner 24 for each of the other patch areas W01 to W16 by the following formula (2).

$$(\text{Corrected Measured Value})=(\text{Measured Value of } Wi)-(\text{Correction Amount}) \quad (2)$$

The corrected measured value is corrected density information measured from a calibration sheet with a difference between a measured value and an expected value of a patch correspondent to white colored materials having an areal ratio of almost 0 as a variation amount of density.

The white correction operation part 50 uses the corrected measured value instead of the measured value, and determines a gradation correction parameter on the basis of a relation between the white toner areal ratio and an expected value of density, and a relation between the white toner areal ratio and corrected measured value of density by the method explained in reference to FIGS. 13 and 14. Thus, even when the engine density level is lower than a standard level, the gradation can precisely be corrected using the maximum toner consumption.

Fourth Embodiment

The scanner 24 has been used as a density measurer in the above embodiments. The density measurer is not limited to the scanner, and a densitometer can be used.

Figure 19:
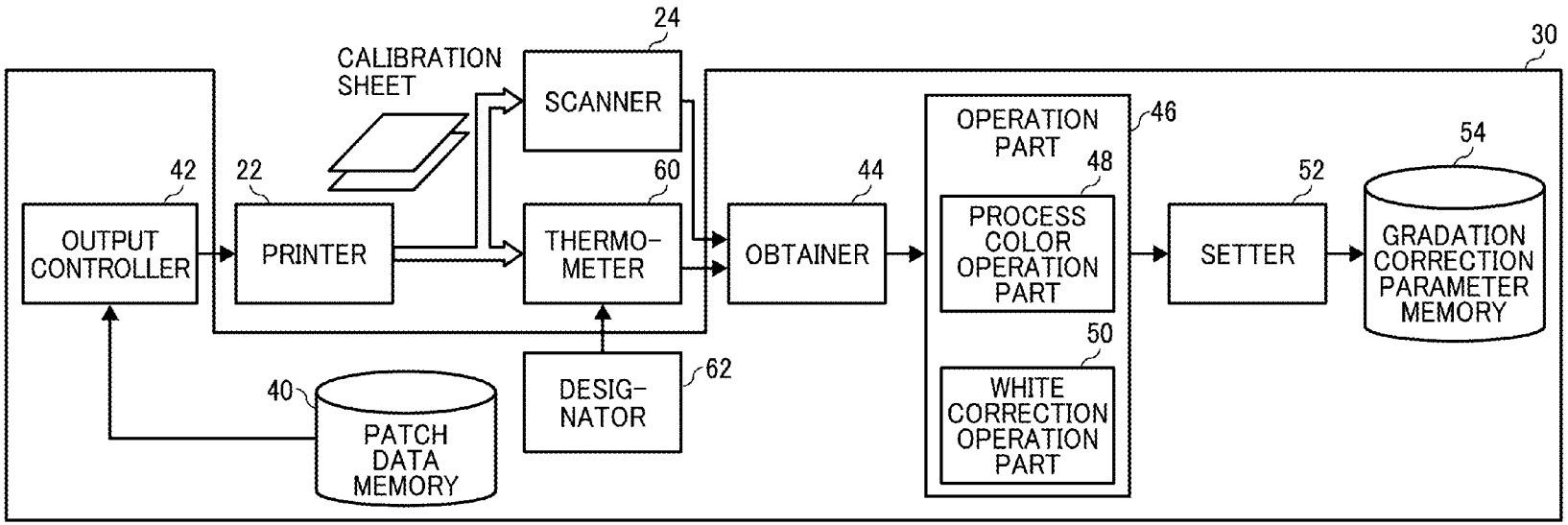
FIG. 19 is a functional block diagram of a controller configuring the image forming system of a fourth embodiment.
Figure 20:
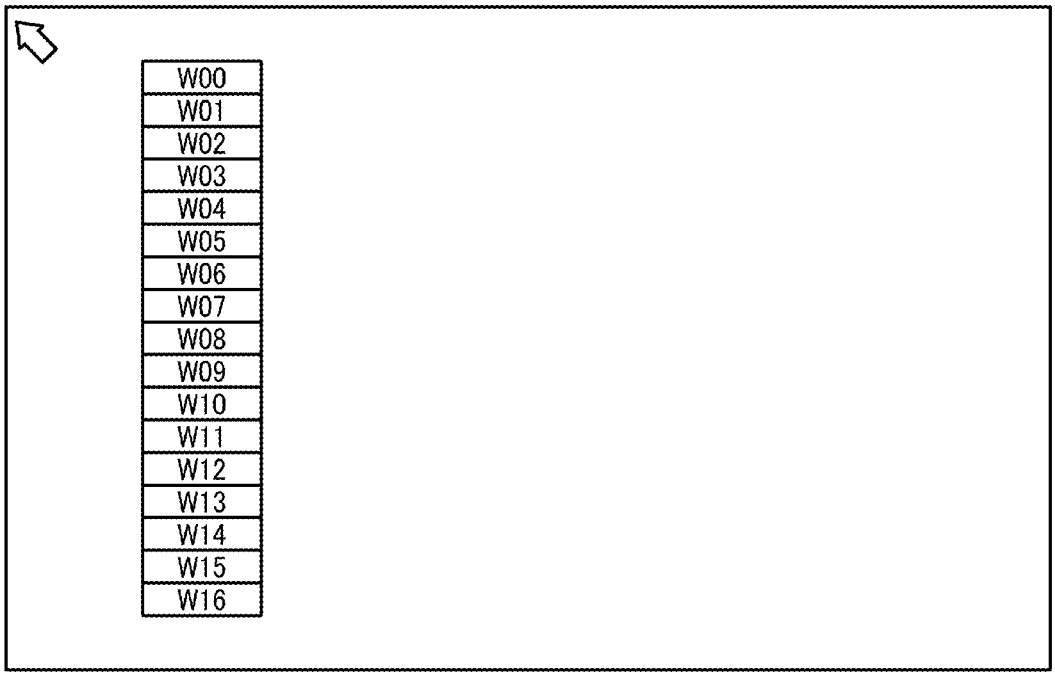
FIG. 20 is an example of a calibration sheet for a white color used in the fourth embodiment.

FIG. 19 is a functional block diagram of a controller configuring the image forming system of a fourth embodiment. FIG. 20 is an example of a calibration sheet for a white color used in the fourth embodiment. Explanations of functions and configurations almost same as those of the image forming system 10 in FIGS. 1 to 14 are omitted.

The image forming system 10 in the fourth embodiment further includes a densitometer 60 in addition to the scanner 24. The image forming system 10 may only include the densitometer 60 without the scanner 24.

The densitometer 60 measures a density and reads a density through a small aperture. Therefore, the densitometer 60 can precisely measure a density of a specific position without receiving influence of scatter light from the circumference.

The controller 30 of the fourth embodiment further includes a designating part 62. The designating part designates the scanner 24 or the densitometer 60 to detect a density of a patch area.

The output controller 42 outputs a calibration sheet for white in FIG. 3B from the printer 22 when using (the designating part 62 designates) the scanner 24 to detect a density in white calibration. Meanwhile, the output controller 42 outputs a calibration sheet for white in FIG. 20 from the printer 22 when using (the designating part 62 designates) the densitometer 60 to detect a density.

The calibration sheet for white in FIG. 20 does not have an area formed of a black toner in the circumference of series of patch areas W00 to W16. A black toner area is formed in the lower layer of the series of patch areas W00 to W16, which is the same as the first embodiment.

In the fourth embodiment, the output controller 42 makes the printer 22 output a calibration sheet including a first layer formed of a toner besides a white toner such as a black toner, and a second layer formed on an area overlapped with the first layer, including a patch area formed of a white toner having almost the same size as the first layer when using the densitometer 60.

Figure 21:
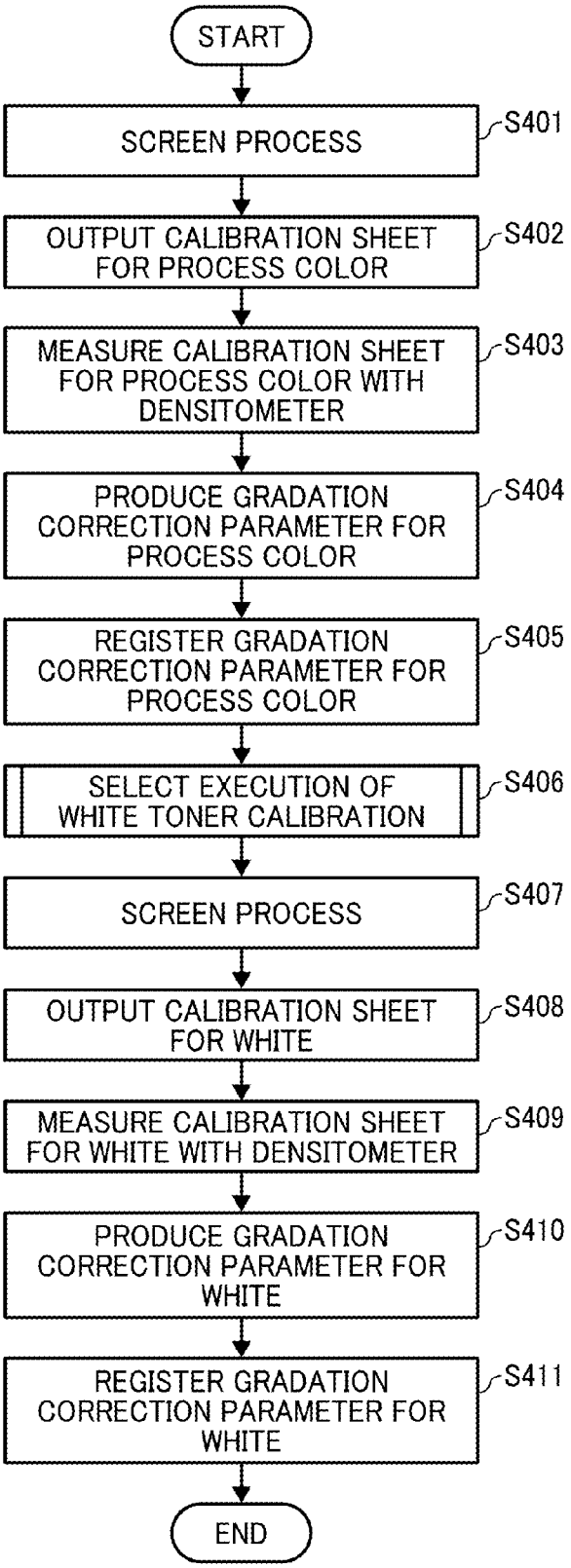
FIG. 21 is a flowchart showing a calibration process executed by the image forming system of the fourth embodiment.

FIG. 21 is a flowchart showing a calibration process executed by the image forming system of the fourth embodiment. The calibration process in the fourth embodiment is different from that of the first embodiment in that STEP S403 and STEP S409 are executed instead of STEP S103 and STEP S109 in FIG. 7 respectively. The other steps are almost same.

At STEPS S403 and S409, the densitometer 60 directly measures a density of a patch area of a calibration sheet for a process color and white. The obtainer 44 obtains a measured value of the density measured by the densitometer 60. The obtainer 44 may not carry out operations such as averaging. At STEPS S404 and S410, the operation part 46 may not make conversions using a conversion table between the measured value by the scanner 24 and the density.

The image forming system 10 in the fourth embodiment does not receive an influence of scattered light from a circumferential white area because the densitometer 60 measured a density. Therefore, a colored toner area in the circumference of a patch area of the calibration sheet can be saved. Namely, the colored toner consumption in printing a calibration sheet can be decreased.

The functional part is executed by computer-executable programs described in legacy programming languages such as assembler, C, C++, C# and Java®; and object-oriented programming languages. The programs are distributed while stored in readable recording media such as ROM, EEPROM, flash memory, flexible disc, CD-ROM, CD-RW, DVD-ROM, DVD-RAM, DVD-RW, blue ray disc, SD card and MO, or through telecommunication lines. A part or all of the functional part can be mounted on programmable devices (PDs) such as field programmable gate array (FPGA) or as an ASIC (application specific integrated circuit). In order realize the functional part on a PD, data described by circuit configuration data (bit stream data) downloading on the PD, HDL (Hardware Description Language) producing the circuit configuration data, VHDL (VHSIC(Very High Speed Integrated Circuits) Hardware Description Language)), Verilog-HDL, etc. are distributed through recording media.

Having now fully described the invention, it will be apparent to one of ordinary skill in the art that many changes and modifications can be made thereto without departing from the spirit and scope of the invention as set forth therein.

What is claimed is:

1. An image forming system, comprising:

an image former configured to form an image with a white coloring material and a colored coloring material;

an output controller configured to control the image former, in a calibration process, to output a first calibration sheet formed with the colored coloring material, and a second calibration sheet including a first layer formed with the colored coloring material and a second layer formed with the white coloring material overlying the first layer;

a density measurer configured to measure density information of each of the first calibration sheet and the second calibration sheet;

a first corrector that corrects a gradation of the colored coloring material on the basis of the measured color density of the first calibration sheet bearing the first layer formed with the colored coloring material and with no white coloring material formed on the first layer;

a second corrector that corrects a gradation of the white coloring material on the basis of the measured color density of the second calibration sheet including the first layer formed, on the second calibration sheet, with a gradation value corresponding to the corrected gradation of the colored coloring material already corrected by the first corrector; and a designated value receiver to receive a user-designated value of coloring material to be consumed in the calibration process in view of dependency of calibration accuracy on coloring material consumption in the calibration process, wherein the output controller controls, based on the user-designated value, an amount of coloring material consumed by the image former to form the image on the second calibration sheet.

2. The image forming system of claim 1, wherein the designated value receiver is configured to receive a designated value of toner consumption used in the correction of gradation of the white coloring material, and wherein the gradation value of the colored coloring material of the first layer is determined based on the designated value of toner consumption received by the designated value receiver.

3. The image forming system of claim 2, further comprising an invalidating means configured to invalidate a choice of designated value of maximum toner consumption when an engine density level is judged to be lower than a standard level on the basis of the density information of the colored coloring material of the first calibration sheet measured by the density measurer.

4. The image forming system of claim 2, wherein when an engine density level of the image former is judged to be lower than a standard level on the basis of the density information of the colored coloring material of the first calibration sheet measured by the density measurer, the second corrector corrects a gradation of the white coloring material using the corrected density information measured from the second calibration sheet with a variation amount which is a difference between a measured value and an expected value of a patch correspondent to an areal ratio almost zero of the white coloring material when the designated value of maximum toner consumption is designated.

5. The image forming system of claim 1, wherein the first calibration sheet includes a plurality of gradation patches of the colored coloring material, the second calibration sheet includes a plurality of plural gradation patches of the white coloring material overlapped on the first layer in the second layer, and positions of the plurality of gradation patches of the colored coloring material of the first calibration sheet are overlapped with positions of the plurality of gradation patches of the white coloring material of the second calibration sheet.

6. The image forming system of claim 1, further comprising:

a controller configured to control the image former;

an information processor configured to be operated by the image former or a device driver correspondent to the image former; and a setter configured to set a gradation correction parameter that is given as a result of gradation correction of the second corrector correcting a gradation of the white coloring material.

7. The image forming system of claim 1, wherein the density measurer is an image reader or a densitometer.

8. A controller for controlling an image former capable of forming images with a white coloring material and a colored coloring material, the controller comprising:

an output controller configured to control the image former, in a calibration process, to output a first calibration sheet formed with the colored coloring material, and a second calibration sheet including a first layer formed with the colored coloring material and a second layer formed with the white coloring material overlying the first layer and including a patch area where a density is detected;

a density obtainer configured to obtain density information from each of the first calibration sheet and the second calibration sheet;

a corrector that (a) corrects a gradation of the colored coloring material on the basis of the density information obtained from the first calibration sheet bearing the first layer formed with the colored coloring material and with no white coloring material formed on the first layer, and (b) corrects a gradation of the white coloring material on the basis of the density information obtained from the second calibration sheet including the first layer formed, on the second calibration sheet, with a gradation value corresponding to the corrected gradation of the colored coloring material already corrected in (a); and a designated value receiver to receive a user-designated value of coloring material to be consumed in the calibration process in view of dependency of calibration accuracy on coloring material consumption in the calibration process, wherein the output controller controls, based on the user-designated value, an amount of coloring material consumed by the image former to form the image on the second calibration sheet.

9. A non-transitory recording medium recording a program that, when executed by a computer, causes the computer to execute a method of controlling an image former capable of forming images with a white coloring material and a colored coloring material, the method comprising the steps of:

(a) controlling the image former, in a calibration process, to output a first calibration sheet formed with the colored coloring material, and a second calibration sheet including a first layer formed with the colored coloring material and a second layer formed with the white coloring material overlying the first layer;

(b) correcting a gradation of the colored coloring material on the basis of density information obtained from the first calibration sheet bearing the first layer formed with the colored coloring material and with no white coloring material formed on the first layer;

(c) correcting a gradation of the white coloring material on the basis of density information measured from the second calibration sheet on which the first layer is formed with a gradation value corresponding to the corrected gradation of the colored coloring material already corrected in (b); and (d) receiving a user-designated value of coloring material to be consumed in the calibration process in view of dependency of calibration accuracy on coloring material consumption in the calibration process, wherein an amount of coloring material consumed by the image former to form the image on the second calibration sheet is controlled in (a) based on the user-designated value in (d).

* * * * *